US009364837B2

(12) United States Patent
Yamaguchi et al.

(10) Patent No.: US 9,364,837 B2
(45) Date of Patent: Jun. 14, 2016

(54) CENTRIFUGAL DEHYDRATION METHOD AND CENTRIFUGAL DEHYDRATION DEVICE

(75) Inventors: Kaoru Yamaguchi, Hiroshima (JP); Toshiya Kitakaze, Hiroshima (JP); Masashi Uehane, Hiroshima (JP); Katsuya Hirano, Hiroshima (JP); Isamu Tobita, Hiroshima (JP)

(73) Assignee: KOTOBUKI INDUSTRIES CO., LTD., Tokyo (JP)

( * ) Notice: Subject to any disclaimer, the term of this patent is extended or adjusted under 35 U.S.C. 154(b) by 209 days.

(21) Appl. No.: 14/001,410

(22) PCT Filed: Feb. 17, 2012

(86) PCT No.: PCT/JP2012/053754

§ 371 (c)(1),
(2), (4) Date: Aug. 23, 2013

(87) PCT Pub. No.: WO2012/114985

PCT Pub. Date: Aug. 30, 2012

(65) Prior Publication Data

US 2013/0337991 A1 Dec. 19, 2013

(30) Foreign Application Priority Data

Feb. 25, 2011 (JP) ..... 2011-039957
Oct. 21, 2011 (JP) ..... 2011-232090

(51) Int. Cl.
*B04B 1/20* (2006.01)

(52) U.S. Cl.
CPC ..... *B04B 1/20* (2013.01); *B04B 2001/2091* (2013.01)

(58) Field of Classification Search
CPC ..... B04B 1/20; B04B 11/00; B04B 11/02; B04B 2001/2091
USPC ..... 494/23, 53, 56
See application file for complete search history.

(56) References Cited

U.S. PATENT DOCUMENTS 2,831,575 A * 4/1958 Maino ..... 494/50
3,228,594 A * 1/1966 Amero ..... 494/23

(Continued)

FOREIGN PATENT DOCUMENTS

DE 859429 C1 12/1952
DE 3622655 A1 1/1988

(Continued)

OTHER PUBLICATIONS

JP 2000237630 Machine translation by Espacenet, Sep. 2000.*

(Continued)

*Primary Examiner* — Charles Cooley
*Assistant Examiner* — Shuyi S Liu
(74) *Attorney, Agent, or Firm* — Westerman, Hattori, Daniels & Adrian, LLP

(57) ABSTRACT

A straight-drum centrifugal dehydration device, wherein extraction of moisture from heavy phase built up in a bowl is facilitated to improve the dehydration effect, and compression efficiency is improved to achieve a reduced load. The straight-drum centrifugal dehydration device, wherein an outer peripheral surface of a rotary drum (21) of a screw conveyor (20) comprises a straight section (24) and a tapered section (25) that spreads outward and away from the straight section, the straight-drum centrifugal dehydration device having an inorganic flocculant feed path for feeding an inorganic flocculant to an inner peripheral surface of the straight section (24) of the rotary drum, and the straight section being provided with an inorganic flocculant addition nozzle (109) communicating with the inorganic flocculant feed path and projecting into an annular space of the bowl and an orifice (108) for adding the inorganic flocculant.

15 Claims, 17 Drawing Sheets

(56) References Cited

U.S. PATENT DOCUMENTS

| | | | | | |
|---|---|---|---|---|---|
| 3,795,361 | A | * | 3/1974 | Lee | 494/26 |
| 5,261,869 | A | | 11/1993 | Caldwell et al. | |
| 5,584,791 | A | * | 12/1996 | Grimwood | B04B 494/53 |

FOREIGN PATENT DOCUMENTS

| | | | | | |
|---|---|---|---|---|---|
| JP | 04-1346 | B1 | | 3/1929 | |
| JP | 36-22669 | Y1 | | 8/1961 | |
| JP | 49-86951 | A | | 8/1974 | |
| JP | 57-9346 | U | | 1/1982 | |
| JP | 61257256 | A | * | 11/1986 | B04B 1/20 |
| JP | 62-13551 | U | | 1/1987 | |
| JP | 06-41000 | B2 | | 6/1994 | |
| JP | 06-190302 | A | | 7/1994 | |
| JP | 09-057152 | A | | 3/1997 | |
| JP | 09-057153 | A | | 3/1997 | |
| JP | 2000-237630 | A | | 9/2000 | |
| JP | 2000-254549 | A | | 9/2000 | |
| JP | 2000237630 | A | * | 9/2000 | B04B 1/20 |
| JP | 2001219097 | A | * | 8/2001 | |
| JP | 2002-153772 | A | | 5/2002 | |
| JP | 2006-192403 | A | | 7/2006 | |
| JP | 4153138 | B2 | | 9/2008 | |
| JP | 2010-264417 | A | | 11/2010 | |

OTHER PUBLICATIONS

International Search Report dated Jun. 5, 2012, issued in corresponding application No. PCT/JP2012/053754.

* cited by examiner

RELATIONSHIP BETWEEN PROCESSING QUANTITY AND DEWATERING PERFORMANCE

CENTRIFUGAL DEHYDRATION METHOD AND CENTRIFUGAL DEHYDRATION DEVICE

TECHNICAL FIELD

The present invention relates to a centrifugal dehydration method and a centrifugal dehydration device for performing solid/liquid separation of a processing liquid and for recovering solids and a separated liquid by means of centrifugal force in sewage treatment and industrial wastewater treatment or from several products in chemical and food industries.

BACKGROUND ART

Conventionally, decanter type centrifugal dehydration devices have been widely used for performing solid/liquid separation of sludge and the like (hereinafter, referred to as a processing liquid) by centrifugal force. Conventional decanter type centrifugal dehydration devices have disadvantages including an occurrence of a phenomenon where centrifugal force weakens and moisture content increases due to a shorter distance from a center of rotation (radius) to a cone section of a bowl. The present applicants have previously provided a straight-drum centrifugal dehydration device (Patent Document 1) as a solution to such disadvantages in the conventional decanter type centrifugal dehydration devices. With the straight-drum centrifugal dehydration device described above, an inner peripheral wall of a bowl forms a cylindrical shape extending along a rotating shaft of the bowl, a discharge path for discharging a sedimentary heavy component to the outside of the bowl is provided in one end wall of the bowl, an opening of the discharge path into the bowl is provided in a vicinity of an inner peripheral wall of the bowl, the discharge path constitutes a choke passage which limits discharge quantity, a deposit layer of a dewatered cake in a compacted state is formed in a vicinity of the opening of the discharge path, and the dewatered cake in the compacted state is directly discharged via the discharge path by centrifugal head pressure which acts on the dewatered cake in accordance with a thickness of the deposit layer formed by a discharge resistance of the choke passage and by a transport force of a screw conveyor. Accordingly, since only a portion subjected to maximum compaction among the dewatered cake deposit layer in the bowl is directly discharged, a moisture content of a dewatered cake can be lowered to a level unparalleled by conventional centrifugal dehydration devices.

On the other hand, in addition to structural/functional improvements to a dehydration device such as described above, separation/dewatering processes are performed by adding one of or both of a polymeric flocculant and an inorganic flocculant to a processing liquid to form a floc in order to further enhance a dehydration effect. Methods of adding such flocculants differ depending on types of dehydrators and types of processing liquids. As a specific method of adding a flocculant when performing solid/liquid separation by a decanter type centrifugal dehydrator, a general method involves feeding a polymeric flocculant together with sludge into a sludge feed chamber in an inner drum from a multiunit tube (for example, refer to Patent Documents 2 and 3). However, other methods have been proposed, including a so-called two-liquid method in which a flocculated floc created in advance by adding a polymeric flocculant to sludge and agitating the sludge and the polymeric flocculant in an external agitation tank and is fed to a sludge feed chamber in an inner drum and, at the same time, an inorganic flocculant is added from inside the inner drum to a sludge deposit which moves toward a small diameter side while being dewatered in a tapered section on an inner periphery of an outer drum (Patent Document 4), and a method in which solid/liquid separation is performed on sludge fed with an inorganic flocculant and a polymeric flocculant in a centrifugal dehydration device and the inorganic flocculant is once again injected into the separated sludge (Patent Document 5).

With respect to the decanter type centrifugal dehydration devices mentioned above, Patent Document 3 describes that the method according to Patent Document 3 is capable of lowering a moisture content of dewatered sludge down to 82%. In addition, Patent Document 4 describes that the method according to Patent Document 4 is capable of lowering a dewatered cake moisture content of sewage-digested sludge to 72.7% using a table-top centrifugal dehydrator in a laboratory, and Patent Document 5 describes performing the method according to Patent Document 5 on similar sewage-digested sludge (sludge concentration 1.5%) at a processing quantity of 1.5 $m^3/h$ and a centrifugal effect of 2500 G resulted in a dewatered cake moisture content of 75.0%.

As described above, with conventional small-size decanter type centrifugal dehydrators, dewatered cake moisture content can only be lowered to around 75% at the most using a real machine in the case of digested sludge.

PRIOR ART DOCUMENTS

Patent Documents

Patent Document 1: Japanese Patent Publication No. 4153138

Patent Document 2: Japanese Patent Application Publication No. 2000-254549

Patent Document 3: Japanese Patent Application Publication No. 2006-192403

Patent Document 4: Japanese Examined Patent Publication No. H6-41000

Patent Document 5: Japanese Patent Application Publication No. 2010-264417

SUMMARY OF INVENTION

Problem to be Solved by the Invention

With the proposed straight-drum centrifugal dehydration device described above, since only a portion subjected to maximum compaction among an internally-dewatered cake deposit layer is directly discharged, a moisture content of a dewatered cake can be lowered to a level significantly lower than those realized by conventional centrifugal dehydration devices. However, since a wall is erected outward in a radial direction from a tip of an inner cylinder of a screw conveyor and extends to an entrance of a discharge path, the straight-drum centrifugal dehydration device is problematic in that the dewatered cake deposit layer hits a wall of a front end portion of a bowl and forms a large deposit layer in this portion due to discharge resistance of the discharge path that constitutes a choke passage, which makes it difficult for an internally-dewatered cake to move in this portion from a high-centrifugal force field to the discharge path and tends to increase operating load and which also makes it difficult for moisture to be extracted from a low-centrifugal force portion on an inner cylindrical side of a screw conveyor.

Meanwhile, although a dehydration effect can conceivably be further enhanced by adopting a two-liquid method in which an inorganic flocculant is added in addition to a polymeric flocculant in a similar manner to the decanter type centrifugal dehydrators described in Patent Documents 4 and 5, inorganic flocculants such as polyferric sulfate have a low flocculating effect in water and are not effective unless dewatering has already been performed to a certain degree or, in other words, unless the addition takes place internally. However, with conventional straight-drum centrifugal dehydration devices, since a front end portion of a bowl is a vertical wall as described above and the dewatered cake deposit layer is formed at the vertical wall, internally adding the inorganic flocculant causes the inorganic flocculant to solidify at the deposit layer, which prevents discharge, causes internal blockage, and disables operations. Therefore, conventional straight-drum centrifugal dehydration devices are problematic in that a two-liquid adding method in which the inorganic flocculant is post-added cannot be adopted.

In consideration thereof, the present invention has been made in order to solve the problems described above which occur with straight-drum centrifugal dehydration devices. A first object of the present invention is to provide a centrifugal dehydration method and a straight-drum centrifugal dehydrator capable of enhancing a dehydration effect by facilitating extraction of moisture from a dewatered cake in a bowl and reducing load in the device by enhancing compression efficiency, and a second object of the present invention is to provide a centrifugal dehydration method and a straight-drum centrifugal dehydrator capable of adopting a two-liquid adding method in which an inorganic flocculant is post-added and further enhancing the dehydration effect.

Means for Solving Problem

A straight-drum centrifugal dehydration method according to the present invention which solves the problems described above is a centrifugal dehydration method implemented by a straight-drum centrifugal dehydration device in which solid/liquid separation of a processing liquid is performed and solids and a separated liquid are recovered, with this device being formed to have a straight-drum bowl which rotates in one direction and a screw conveyor constructed by having a spiral blade wound around an outer periphery of a rotary drum which is housed in the bowl and which coaxially rotates with the bowl in the same direction while having a difference in rotational speed from the bowl, with this straight-drum centrifugal dehydration device being formed of a straight section in which an inner peripheral wall of the bowl forms a cylindrical shape extending along a rotating shaft of the bowl and in which an upstream side of an outer peripheral surface of the rotary drum of the screw conveyor is constituted by a straight circumferential surface, and also being formed of a tapered section whose downstream side spreads outward and away from the straight section, the method being implemented in which the processing liquid is fed into an annular space between the bowl and the screw conveyor via a processing liquid feed chamber formed inside the rotary drum, while solid/liquid is separated by centrifugal force created by rotation of the bowl and the screw conveyor, the separated liquid is discharged from a separated liquid discharge opening, a dewatered cake is pushed into a dewatered cake discharge path by centrifugal head pressure and a transport force of the screw conveyor, and the dewatered cake is gradually moved to a high-centrifugal force field by the tapered section toward the dewatered cake discharge path and is dewatered by gradually reducing a passage area of the dewatered cake toward the side of the dewatered cake discharge path.

In the straight-drum centrifugal dehydration method according to the present invention, desirably, a ratio L1/L2 of an axial length L1 of the straight section from a processing liquid feed opening of the rotary drum to a starting point of the tapered section and an axial length L2 of the tapered section of the rotary drum ranges from 1.2 to 5.0, thereby increasing a pushing force from the straight section and further reducing moisture content.

The second object described earlier can be achieved by having: a processing liquid feeding step of feeding the processing liquid and a polymeric flocculant into the processing liquid feed chamber; and an inorganic flocculant adding step of feeding the processing liquid, to which the polymeric flocculant has been added from the processing liquid feed chamber, to an annular space in an inner periphery of the bowl via a feed opening formed on the rotary drum and adding an inorganic flocculant from inside the rotary drum of the screw conveyor to the dewatered cake which is transported by the screw conveyor while being dewatered by centrifugal force.

In the straight-drum centrifugal dehydration method according to the present invention, desirably, in the inorganic flocculant adding step, the inorganic flocculant is added to the dewatered cake between the straight section of the screw conveyor on a downstream side of the feed opening and an upstream end of the tapered section from the perspective of preventing an internal blockage of the dewatered cake in the tapered section. In addition, desirably, the addition of the inorganic flocculant is performed by a combination of adding the inorganic flocculant to a surface of the dewatered cake and adding the inorganic flocculant to an inside of the dewatered cake from the perspective of further enhancing dehydration efficiency.

A straight-drum centrifugal dehydration device according to the present invention which implements the straight-drum centrifugal dehydration method described above has: a straight-drum bowl which rotates in one direction; and a screw conveyor constructed by having a spiral blade wound around an outer periphery of a rotary drum which is housed in the bowl and which coaxially rotates with the bowl in the same direction while having a difference in rotational speed from the bowl, this straight-drum centrifugal dehydration device further having: a straight section in which an inner peripheral wall of the bowl forms a cylindrical shape extending along a rotating shaft of the bowl and in which an upstream side of an outer peripheral surface of the rotary drum of the screw conveyor is constituted by a straight circumferential surface; and a tapered section whose downstream side spreads outward and away from the straight section, wherein an inclination angle of a taper starting portion of the tapered section ranges from 5 to 30 degrees.

In the straight-drum centrifugal dehydration device according to the present invention, desirably, a ratio L1/L2 of an axial length L1 of the straight section from a processing liquid feed opening of the rotary drum to a starting point of the tapered section and an axial length L2 of the tapered section of the rotary drum ranges from 1.2 to 5.0 in order to enhance compression efficiency.

Furthermore, the straight-drum centrifugal dehydration device according to the present invention is capable of achieving the second object described above when configured so as to comprise an inorganic flocculant feed path which feeds an inorganic flocculant to an inner peripheral surface of the straight section of the rotary drum and an inorganic flocculant addition nozzle which is provided in the straight section and which communicates with the inorganic flocculant feed path, penetrates the rotary drum, and protrudes into an annular space of the bowl and an orifice for adding the inorganic flocculant.

In addition, an inorganic flocculant feed path is provided which feeds an inorganic flocculant to an inner peripheral surface of the straight section of the rotary drum, and an inorganic flocculant addition nozzle is provided in the straight section, the inorganic flocculant addition nozzle communicating with the inorganic flocculant feed path, penetrating the rotary drum, and protruding into an annular space of the bowl and an orifice for adding the inorganic flocculant.

Furthermore, desirably, the tapered section has a two-stage structure with different inclination angles including a first-stage inclination angle that is a gentle inclination angle and a subsequent second-stage inclination angle that is steeper than the first-stage inclination angle in order to effectively prevent a short path to a discharge side of a high-moisture content dewatered cake. In addition, as short path preventing means, forming a dam constituted by an uneven surface at a boundary portion between the straight section and the tapered section and/or in the middle of the tapered section, providing a notch at a part of a base portion of the spiral blade attached to the rotary drum arranged in the tapered section, or the like can be effectively adopted.

Effect of Invention

The centrifugal dehydration method adopted by a straight-drum centrifugal dehydration device according to claim 1 and the straight-drum centrifugal dehydration device according to claim 6 of the present invention produce the superior effects described in (1) to (4) below.

(1) By forming the outer peripheral surface of a rotary drum as a tapered shape that spreads outward and away toward a dewatered cake discharge side in a range of 5 to 30 degrees, the discharged dewatered cake can be gradually moved to a high-centrifugal force field. As a result, moisture extraction is facilitated and a moisture content of the dewatered cake can be lowered.

(2) By forming the outer peripheral surface of the rotary drum as the tapered shape that spreads outward and away toward a dewatered cake discharge side, a buildup of a dewatered cake in a compacted state does not occur at a discharge-side end portion as is the case with conventional straight-drum centrifugal dehydration devices and discharge of a dewatered cake is facilitated.

(3) Since the screw conveyor has the tapered section that spreads outward and away, pushing pressure can be effectively used due to a volume of a dewatered cake gradually decreasing toward the dewatered cake discharge side, and increased compression force lowers dewatered cake moisture content and facilitates discharge of the dewatered cake. As a result, since pressure under load can be reduced, device load decreases and a reduction in power consumption can be achieved.

(3) Due to the tapered section, a highly-dewatered cake retention volume increases and an effect of preventing leakage to the dewatered cake side during a negative dam can be expected.

(4) Since a dewatered cake transport force and head pressure can be effectively utilized as pushing pressure, intra-device blockage due to the dewatered cake during operation can be significantly reduced.

The centrifugal dehydration method adopted by a straight-drum centrifugal dehydration device according to claim 3 and the straight-drum centrifugal dehydration device according to claim 8 of the present invention produces the following effects in addition to the effects described in (1) to (4) above.

(5) Providing the tapered section enables discharge of the dewatered cake to be facilitated while avoiding a buildup of the dewatered cake in a compacted state at the discharge-side end portion as is the case with conventional straight-drum centrifugal dehydration devices. As a result, internal addition of an inorganic flocculant which could not be performed by conventional straight-drum centrifugal dehydration devices can now be carried out and the dewatered cake with even lower moisture content can be produced.

(6) The inorganic flocculant internally added to the processing liquid is effectively mixed with the processing liquid at the tapered section and further lowers the dewatered cake moisture content.

(7) Since the inorganic flocculant is internally added to the dewatered cake whose moisture content is being lowered, a high flocculating effect can be produced and a dehydration effect can be enhanced.

(8) Since a dewatered cake transport force and head pressure can be effectively utilized as pushing pressure, intra-device blockage due to the dewatered cake during operation can be significantly reduced.

With the invention according to claim 4, in addition to the effects (1) to (8) listed above, since the inorganic flocculant is internally added at the straight section to a dewatered cake whose moisture content is being lowered, a high flocculating effect can be produced and a dehydration effect can be enhanced. In addition, since the addition of the inorganic flocculant is not performed in the tapered section where compression force increases to maximum, solidification of the dewatered cake at the tapered section can be effectively prevented and discharge can be facilitated.

In addition, with the inventions according to claims 5 and 8, since the addition of the inorganic flocculant to the dewatered cake is performed by a combination of adding the inorganic flocculant to a surface of the dewatered cake and adding the inorganic flocculant to an inside of the dewatered cake, the inorganic flocculant and the dewatered cake can be efficiently and uniformly mixed with each other.

With the invention according to claim 7, even if the tapered section is provided, since a transport force due to the straight section effectively acts as a pushing force to the tapered section, transport failures do not occur.

With the invention according to claim 9, the dewatered cake is gradually compressed at the gentle tapered section of the first stage, and a high-moisture content dewatered cake of a low-centrifugal force portion is moved on the gradual tapered section toward a separated liquid side by a steep slope section of the second stage without moving to a bottom portion of the bowl (cake discharge opening). In this case, even if a short path occurs in the first stage tapered section, since a push back occurs in the second stage tapered section, a reduction of approximately 3 to 4% in moisture content is achieved in comparison to the conventional straight-drum type.

With the invention according to claim 10, providing a dam by forming an uneven level at an entrance of the tapered section and/or in the middle of the tapered section, the short path of a high-moisture content dewatered cake to the tapered section can be effectively prevented.

With the invention according to claim 11, by providing a notch on the spiral blade, a high-moisture content dewatered cake is prevented from being pushed and moved to the tapered section by the spiral blade and the short path of the high-moisture content dewatered cake to the discharge side can be effectively prevented.

EXPLANATION OF REFERENCE NUMERALS

Figure 1:
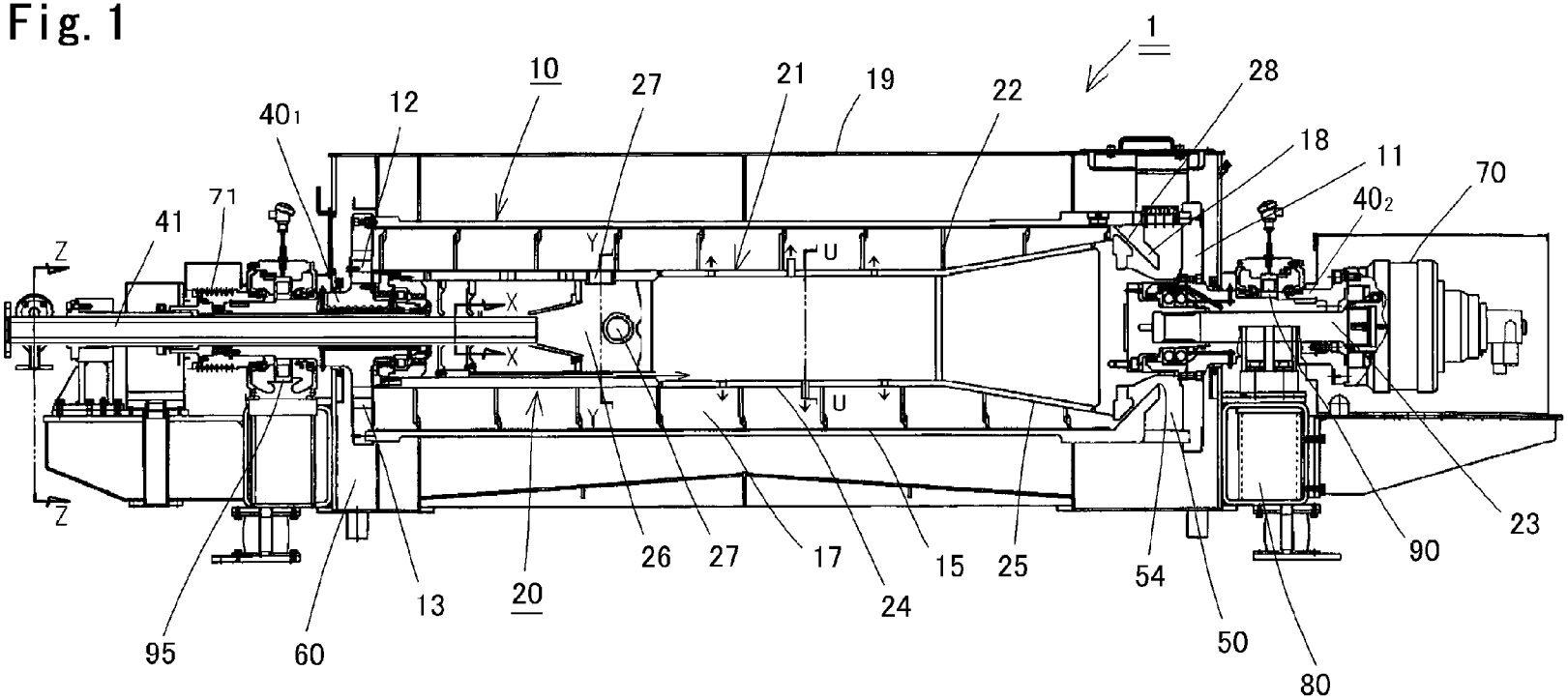
FIG. 1 is a front sectional view of a centrifugal dehydration device according to an embodiment of the present invention.

1: straight-drum centrifugal dehydration device
10: bowl
11: wall of dewatered cake discharge chamber
12: rear end wall of bowl
13: separated liquid discharge opening
14: dewatered cake
15: inner surface of peripheral wall
17: annular space
18: bowl-side choke passage member
19: casing
20: screw conveyor
21: rotary drum
22: spiral blade
23: rotating shaft
24: straight section
25: tapered section
26: feed chamber
27: feed opening
28: inverse tapered surface
29: dam
30: notch
35: downstream-side hollow shaft
$40_1$: upstream-side hollow shaft
$40_2$: downstream-side hollow shaft
41: processing liquid feed tube
50: dewatered cake discharge chamber
52: dewatered cake discharge path
53: entrance
54: exit
60: separated liquid discharge chamber
70: drive device
80: base frame
90, 95: bearing portion
100: inner tube
101: outer tube
**101*a***: polymeric flocculant feed path
**101*b***: inorganic flocculant feed path
**101*c***: washing water feed path
**102*a* to 102*c***: feed opening
104: radial flow path
105: axial flow path
108: orifice
109: nozzle

BEST MODE FOR CARRYING OUT THE INVENTION

Hereinafter, an embodiment of a centrifugal dehydration device according to the present invention will be described in detail with reference to the drawings.

Figure 2:
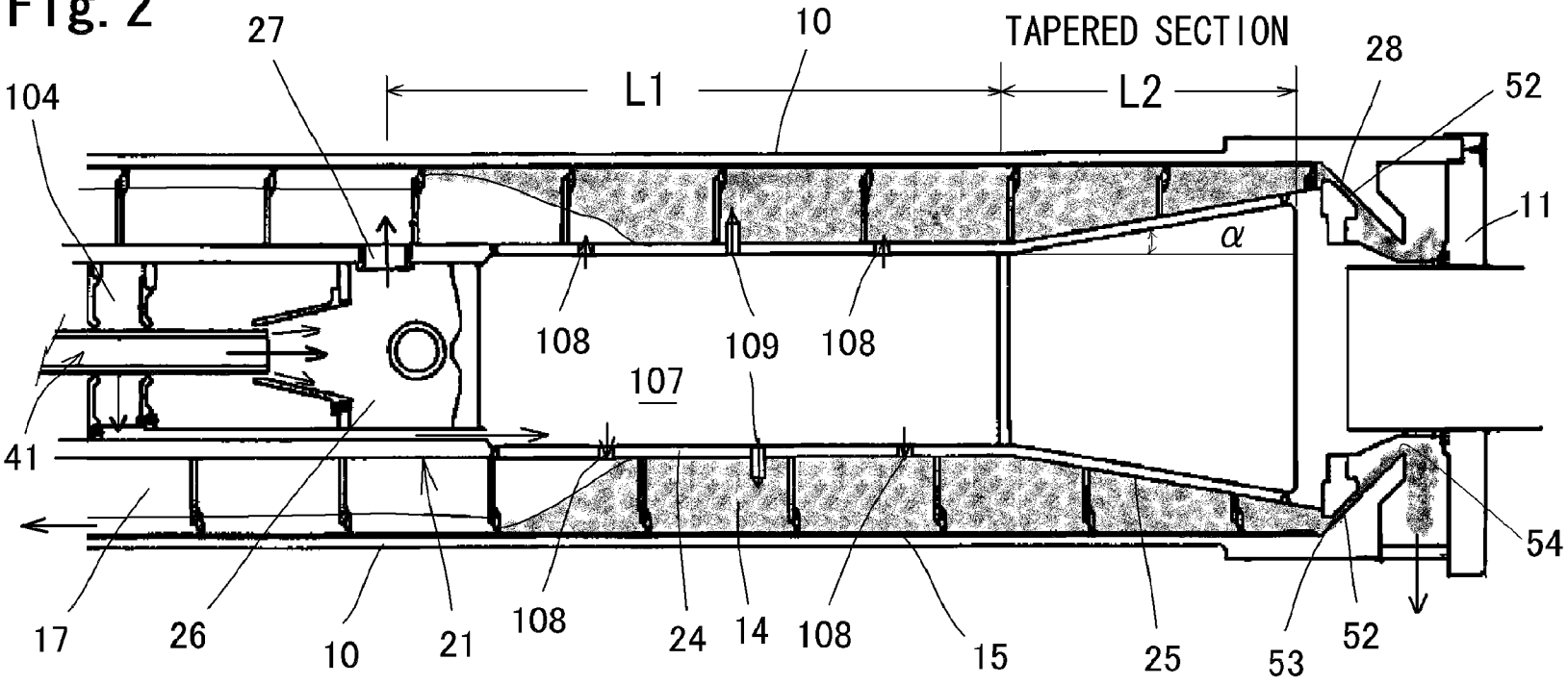
FIG. 2 is an enlarged schematic sectional view of a substantial part of the centrifugal dehydration device according to the embodiment of the present invention.

FIG. 1 shows a straight-drum centrifugal dehydration device 1 according to the present embodiment, and FIG. 2 is an enlarged schematic view of a substantial part thereof. The straight-drum centrifugal dehydration device 1 according to the present embodiment comprises a bowl 10 with a cylindrical straight drum shape, a screw conveyor 20 which is arranged in the bowl and which rotates in a same direction as the bowl while having a difference in speed relative to the bowl, hollow shafts 35 and 40 formed so as to protrude from both end portions of the bowl 10 and the screw conveyor 20, a dewatered cake discharge chamber 50 provided at a front end of the screw conveyor, and a separated liquid discharge chamber 60 provided at a rear end portion. In addition, the bowl 10, the screw conveyor 20 mounted inside the bowl 10, the dewatered cake discharge chamber 50, and the separated liquid discharge chamber 60 are housed inside a casing 19.

The bowl 10 has a shape of a horizontal and cylindrical straight drum. A front end of the bowl constitutes a wall 11 of the dewatered cake discharge chamber and a rear end of the bowl constitutes a rear end wall 12 of the bowl on which a separated liquid discharge opening 13 is formed. While the separated liquid discharge opening 13 is desirably provided as a large number of isolated small holes arranged in a concentric pattern on the rear end wall 12 of the bowl, such an arrangement is not restrictive and the separated liquid discharge opening 13 may be formed in any appropriate shape or pattern.

An upstream-side hollow shaft $40_1$ formed so as to protrude outward from a center portion of the rear end wall 12 of the bowl is rotatably borne by a bearing 95 provided on a base frame 80, and a downstream-side hollow shaft $40_2$ formed so as to protrude outward from a center portion of the wall 11 of the dewatered cake discharge chamber which is the front end wall of the bowl is rotatably borne by a bearing portion 90. A pulley 71 is provided on an outer periphery of the hollow shaft $\mathbf{40}_1$, and power is transmitted to the pulley 71 from a motor as a drive source (not shown) to rotationally drive the bowl 10. A tip portion of the hollow shaft $\mathbf{40}_2$ is connected to a variable speed gear 70. A screw conveyor drive shaft 23 which rotatably penetrates the inside of the hollow shaft $\mathbf{40}_2$ is also connected to the variable speed gear 70. Torque of the hollow shaft $\mathbf{40}_2$ is transmitted to the screw conveyor drive shaft 23 via the variable speed gear 70 and the screw conveyor 20 is rotationally driven in a same direction as the bowl 10 while having a difference in speed relative to the bowl 10.

In addition, a processing liquid feed tube 41 with a double tube structure whose outer peripheral portion constitutes a flocculant feed tube (to be described later) penetrates a center portion of the upstream-side hollow shaft $\mathbf{40}_1$ and is capable of feeding a processing liquid and a flocculant to the inside of a rotary drum 21 of the screw conveyor.

The screw conveyor 20 arranged in the bowl is internally constituted by a spiral blade 22 wound around an outer periphery of the hollow rotary drum 21 and is designed to be rotated in the same direction as the bowl 10 by the drive device while having a predetermined difference in speed relative to the bowl 10 as described above. As shown in FIGS. 1 and 2, an outer peripheral surface of the rotary drum 21 is constituted by a cylindrical straight section 24 and a tapered section 25. As shown in FIG. 2, the straight section 24 extends from an upstream-side end portion of the rotary drum until reaching a position separated by a distance L1 from a dewatered cake feed opening 27 toward the downstream side of the rotary drum, while the tapered section 25 is formed near a downstream side of the rotary drum in a range of an axial distance L2 and inclines toward an inner peripheral wall of the bowl at an inclination angle $\alpha$ up to an entrance of a discharge path of a dewatered cake 14. The tapered section 25 is formed with a focus on the fact that by giving a conventional straight-structure rotary drum a tapered structure that spreads outward toward a dewatered cake discharge side, compression force increases as a dewatered cake is transported in a dewatered cake discharge direction and a moisture content of the discharged dewatered cake decreases.

However, setting a taper angle of the tapered section of the rotary drum to a steep slope of 30 degrees or more results in transport failure and a carryover occurs in which the dewatered cake flows out from the separated liquid side, thereby preventing increases in transport load. Accordingly, no improvement in dewatered cake moisture content was observed. Various experiments yielded desirable results when the taper angle $\alpha$ is less than 30 degrees and yielded particularly desirable results when the taper angle is 10 to 15 degrees. Moreover, the term "taper angle" as used herein refers to an angle of a taper starting portion of the tapered section. However, as will be described later, the taper angle is desirably set to an inclination angle exceeding the range described above on a downstream side when the tapered section is formed in a plurality of stages, in which case the taper angle will refer to an angle formed between a straight line connecting a start end and a rear end portion of the tapered section and a center line. Therefore, even if the taper angle exceeds the range described above in a vicinity of a downstream end portion as in the case of the embodiment described later, an angle of the straight line connecting the start end and the rear end portion of the tapered section is desirably in a range of less than 30 degrees. In addition, with respect to a ratio of the distance L1 of the straight section of the rotary drum from the processing liquid feed opening and the tapered section distance L2, since a transport force of the straight section 24 becomes a pushing force toward the tapered section, reducing L1 results in insufficient pushing force and transport failure, and causes a carryover. Therefore, the ratio of L1 and L2 is desirably L1/L2=1.2 to 5. More desirably, L1/L2=1.2 to 1.5. In order to downsize the device, L1/L2<1.2 is unfavorable since pushing force from the straight portion declines and moisture content decreases, and at least L1/L2>5 is unfavorable since an axial length of the device becomes unnecessarily long. On the other hand, if L2 is too short, the taper angle increases and causes transport failure as described above, and an effect of reducing dewatered cake moisture content is minimal.

At a downstream end of the tapered section 25 or, in other words, at a position which is nearest to the inner peripheral wall of the bowl and which is subjected to high-centrifugal force, an inverse tapered surface 28 that is inclined inward from this position is formed. Together with a bowl-side inverse tapered surface (to be described later), the inverse tapered surface 28 forms a choke passage 52 that functions as a dewatered cake discharge path. While a member constituting the inverse tapered surface 28 is formed by a disk member that is a separate member from the rotary drum 21 in the embodiment shown, the inverse tapered surface 28 may alternatively be integrally formed with the rotary drum 21. Forming the inverse tapered surface 28 by the separate member from the rotary drum advantageously enables a shape or a sectional area of the choke passage to be adjusted according to properties of the processing liquid and the like.

On the other hand, a bowl-side choke passage member 18 is adjustably attached to a vicinity of a downstream end portion of the inner peripheral surface of the bowl 10 so as to oppose the rotary drum-side inverse tapered surface 28. While the bowl-side choke passage member 18 is also formed as the separate member from the bowl in the present embodiment, the bowl-side choke passage member 18 may alternatively be integrally formed with the bowl. The rotating drum-side choke passage member 28 and the bowl-side choke passage member 18 constitute the dewatered cake discharge path 52 which functions as a choke passage with a conical annular cross section whose sectional area gradually decreases toward the downstream side.

Therefore, an entrance 53 to the dewatered cake discharge path 52 or, in other words, an opening of the bowl to the discharge path is provided in contact with an inner surface 15 of the peripheral wall of the bowl 10. On the other hand, an exit 54 from the dewatered cake discharge path 52 that functions as a discharge opening to outside of the bowl has a height in a radial direction. Accordingly, the dewatered cake that can penetrate into the discharge path 52 from the entrance 53 is limited to a bottommost layer portion of a deposit layer. On the other hand, since the processing liquid is fed in an initial stage of operation so as not to overflow from the exit 54, the exit 54 defines an initial height of a liquid surface inside the bowl. If the exit 54 of the discharge path is too high, centrifugal force that acts on the dewatered cake inside the discharge path 52 cancels pushing force acting on a dewatered cake layer inside the bowl and reduces a discharge force of the dewatered cake. Therefore, the exit 54 is desirably constructed as low as possible in a necessary range.

Meanwhile, the separated liquid discharge opening 13 defines a liquid surface in an annular space 17 during operation. When a position of the separated liquid discharge opening 13 is lower than the exit 54, operation is carried out in a "downside overflow" state, and when the position of the separated liquid discharge opening 13 is higher, operation is carried out in an "upside overflow" state. In addition, when operation is carried out in the upside overflow state, outflow of the processing liquid from the dewatered cake discharge path 52 is blocked by the dewatered cake deposited in a vicinity of the entrance 53 of the dewatered cake discharge path. In an extreme case, since the separated liquid can also be discharged through the shaft center, the separated liquid does not overflow from the exit 54 of the dewatered cake.

Next, means and a method of adding a flocculant in the device above will be described.

Figure 3:
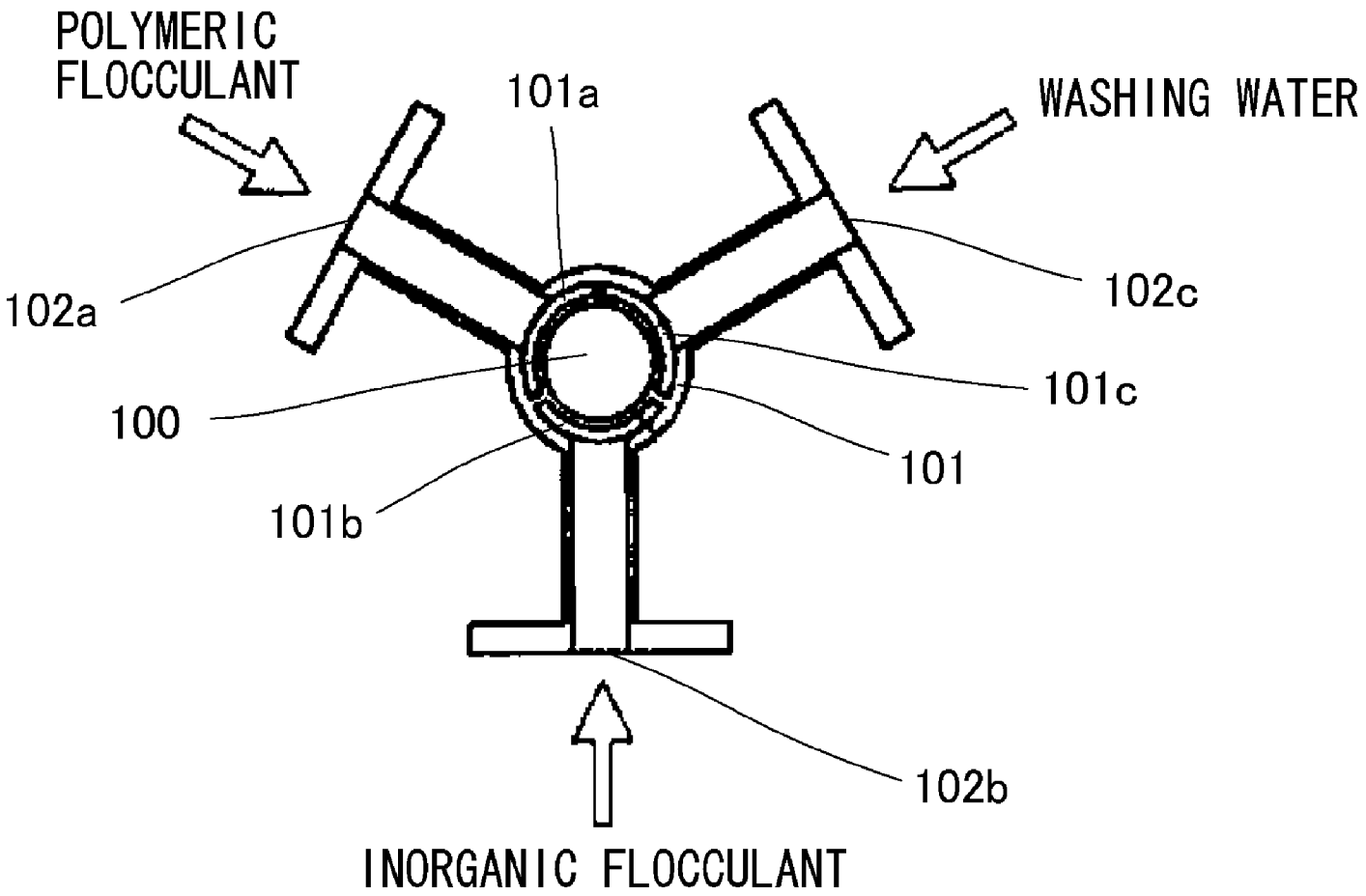
FIG. 3 is a sectional view taken along Z-Z in FIG. 1.
Figure 4:
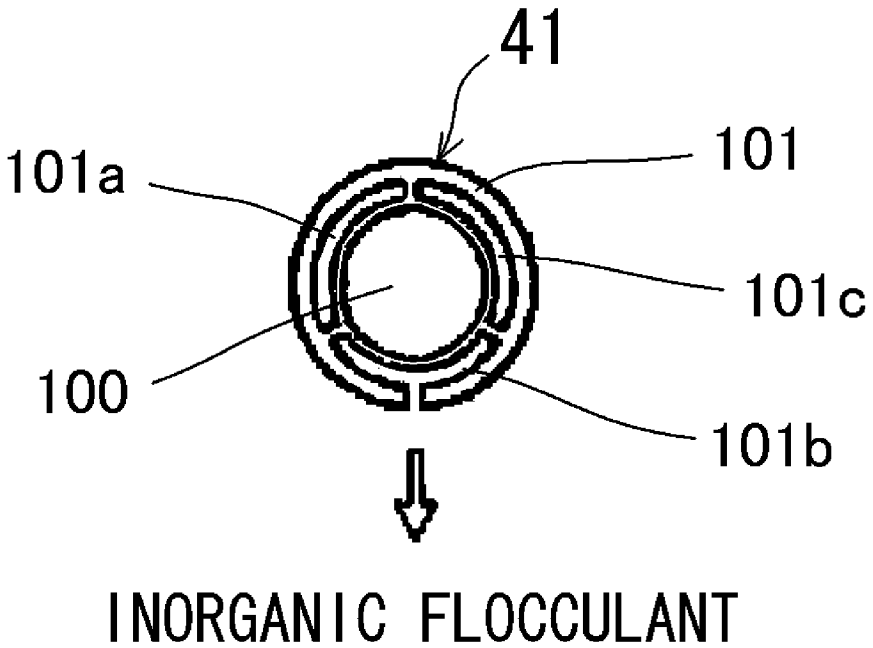
FIG. 4 is a sectional view taken along X-X in FIG. 1.

A processing liquid feed chamber 26 is provided inside the rotary drum 21. A plurality of feed openings 27 communicating with the annular space 17 between the bowl 10 and the rotary drum 21 is opened on a peripheral wall of the feed chamber 26, and a processing liquid feed tube 41 inserted through the hollow shaft 40 of the bowl 10 is provided so as to open to the feed chamber 26. As shown in FIGS. 3 and 4 which represent cross sections respectively taken along Z-Z and X-X in FIG. 1, in the processing liquid feed tube with a double structure, an inner tube 100 constitutes a processing liquid passage and an outer tube 101 which surrounds the outside of the inner tube 100 is divided three ways into a polymeric flocculant feed path 101*a*, an inorganic flocculant feed path 101*b*, and a washing water feed path 101*c*. The three feed paths are respectively provided at upstream ends thereof with feed openings 102*a*, 102*b*, and 102*c* which enable the feed paths to be connected.

Figure 5:
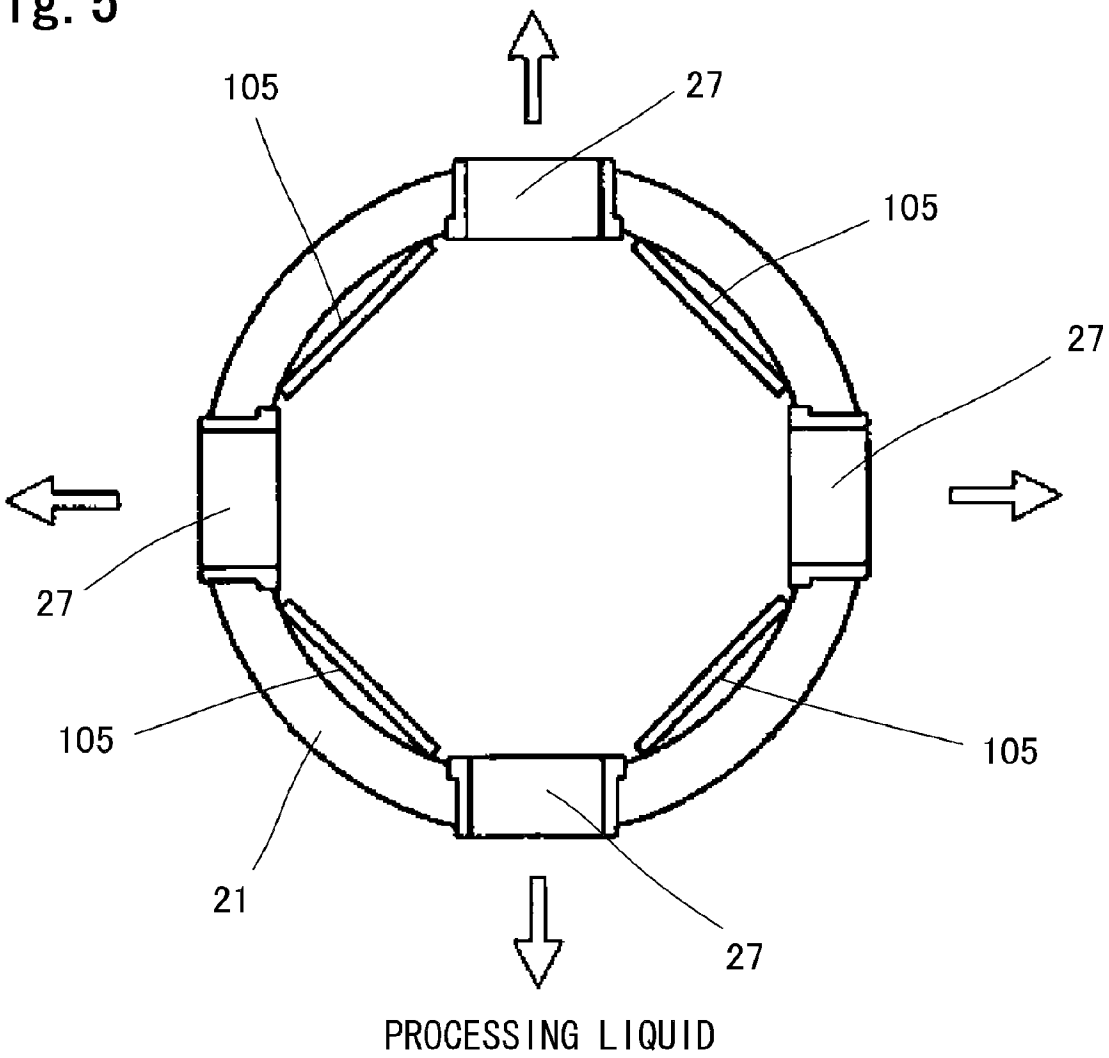
FIG. 5 is a sectional view taken along Y-Y in FIG. 1.

The polymeric flocculant feed path 101*a* extends as-is along the inner tube 100 and opens at the processing liquid feed chamber 26, and enables a polymeric flocculant to be fed into the feed chamber from around the processing liquid and agitated and mixed with the processing liquid. On the other hand, as shown in FIG. 5, on an upstream side where the processing liquid feed tube 41 reaches the processing liquid feed chamber 26, the inorganic flocculant feed path 101*b* opens and communicates with a radial flow path 104 communicating with axial flow paths (four in the illustrated embodiment) 105 of the inorganic flocculant which are demarcated along the inner peripheral surface of the rotary drum 21, and is configured so as to add the inorganic flocculant to a surface and an inside of a dewatered cake that is centrifugally dehydrated in the bowl as will be described later.

The processing liquid feed chamber 26 is partitioned and formed on the upstream side inside the rotary drum 21 as described above, and an internal space of the straight section on the downstream side of the processing liquid feed chamber 26 constitutes an inorganic flocculant adding area 107 so as to prevent the inorganic flocculant from reaching the tapered section. In the present invention, the following innovations were made in order to ensure that the inorganic flocculant mixes efficiently with the processing liquid, to ensure that a flocculating effect is effectively enhanced to contribute to improving dewatering ratio, and to prevent discharge from the bowl of the dewatered cake from being inhibited even at a high dewatering ratio and to enable favorable discharge.

Figure 6:
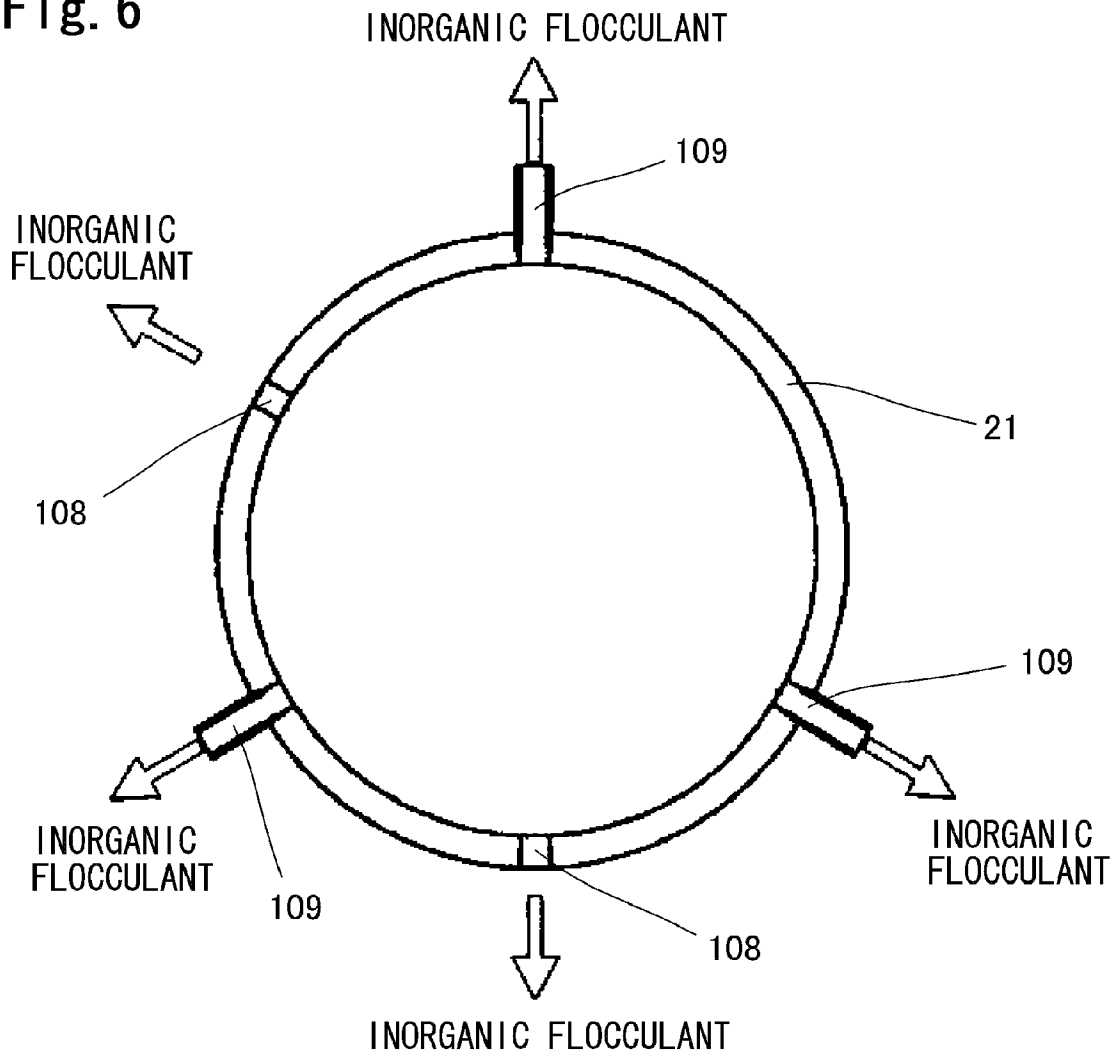
FIG. 6 is a sectional view taken along U-U in FIG. 1.

The inorganic flocculant is less effective when the processing liquid has a high moisture content. Therefore, in the present embodiment, as shown in FIG. 6, a drum wall of the rotary drum 21 of the straight section on the downstream side of the feed chamber up to the tapered section where a dehydration effect begins to act on the processing liquid due to action of centrifugal force and pushing force of the screw conveyor is provided with a plurality of orifices 108 which communicates with the axial flow paths 105 of the inorganic flocculant and a nozzle 109 which extends and protrudes into the bowl from the drum wall. Accordingly, the inorganic flocculant from the orifices 108 of the rotating drum wall is post-added to the surface of the dewatered cake 14 being subject to a dewatering process in a centrifugal field and also post-added to the inside of the dewatered cake 14 through the nozzle 109. As a result, the inorganic flocculant is effectively and uniformly added to the dewatered cake. A post-addition position of the inorganic flocculant is desirably an interval of 1 to 2 pitches of the spiral blade 22 of the screw conveyor from the processing liquid feed opening 27 toward the cake discharge side. Therefore, the orifices and the nozzle are desirably provided in the interval of the straight section.

An experiment conducted by the present inventors revealed that compared to a case where the inorganic flocculant is only added by the orifices to the surface of the dewatered cake from the inner peripheral surface of the rotary drum or a case where the inorganic flocculant is only added by the nozzle to the inside of the dewatered cake, an addition effect is enhanced by combining the orifices with the nozzle. Accordingly, in the present embodiment, the orifices and the nozzle are arranged at the position described above. In addition, adding a flocculant at the tapered section where compression force increases causes a dewatered cake to solidify and pressing by a screw becomes difficult. Therefore, the inorganic flocculant is not added at the tapered section and is only added at the straight section.

In the device described above, the processing liquid to be subjected to the dewatering process enters the processing liquid feed chamber 26 from the processing liquid feed tube 41 and is fed into the annular space 17 from the feed opening 27, subjected to solid/liquid separation by centrifugal force created by the rotation of the bowl 10 and the screw conveyor 20, and transported by the spiral blade 22 toward a front end. In addition, the separated liquid that is a separated liquid component is discharged to the outside of the device from the separated liquid discharge opening 13 on the rear end wall. On the other hand, as the dewatered cake is further subjected to a separation action by centrifugal force while being scraped in the direction of the front end of the bowl 10 by the spiral blade 22, a residual liquid component is further separated and the separated liquid thereof is discharged from the separated liquid discharge opening 13.

Furthermore, in the present invention, the outer peripheral surface of the screw conveyor 20 is given a tapered structure toward the dewatered cake discharge side. Therefore, the dewatered cake is gradually moved to a high-centrifugal force field, and since a passage area of the dewatered cake gradually decreases toward the dewatered cake discharge path side, discharge resistance force and volume reducing force increase. As a result, the moisture content of the dewatered cake can be further lowered. More specifically, since the volume of the dewatered cake at the tapered section gradually decreases, compression efficiency improves and pushing pressure can be used effectively. As a result, pressure under load can be reduced and a reduction in power consumption can be achieved. Furthermore, movement of the dewatered separated liquid from the dewatered cake discharge side of the rotary drum toward the separated liquid discharge side is facilitated, and only the dewatered cake with a low moisture content can be discharged without having any separated liquid mixed into the dewatered cake. In addition, a highly-dewatered cake retention volume increases and an effect of preventing leakage toward a solid side during an upside overflow can be expected. Moreover, since a dewatered cake transport force and liquid pressure can be effectively utilized as pushing pressure, intra-device blockage during operation can be significantly reduced.

As described above, with the straight-drum centrifugal dehydration device according to the present embodiment, when the taper angle is less than 30 degrees and equal to or more than 10 degrees and the ratio L1/L2 of the distance L1 of the straight section from the dewatered cake feed opening and the distance L2 of the tapered section is equal to or greater than 1.2, a reduction in moisture content (in other words, an improvement in dewatering ratio) of 2% or more is achieved compared to conventional straight-drum centrifugal dehydration devices, and a further reduction in moisture content 2% or more is achieved by a two-liquid adding method which involves adding the polymeric flocculant and the inorganic flocculant in the internal straight section.

In addition, in order to further improve the dewatering ratio, additional study conducted on the embodiment described above revealed that in the case of the tapered shape according to the embodiment described above, a high-moisture dewatering cake on a radially inward side moves in the tapered section and is discharged by being mixed with a low-moisture content dewatering cake at a bottom portion of the bowl, which indicates that there are types of dewatering cakes whose cake moisture content cannot be easily lowered. For example, in the case of mixed raw sludge, while a solid component can be sufficiently dewatered down to a limit value, the separated liquid having reached the tapered section adheres to a surface of the solid component and is discharged in this state. As a result, moisture content reduction is inhibited.

In other words, a short path of the high-moisture content dewatered cake toward the tip of the tapered section occurs. Therefore, by suppressing the short path by the high-moisture content dewatered cake, dewatering ratio can be further improved. A further study conducted regarding methods for preventing the short path revealed that methods such as those described below are effective.

Figure 7:
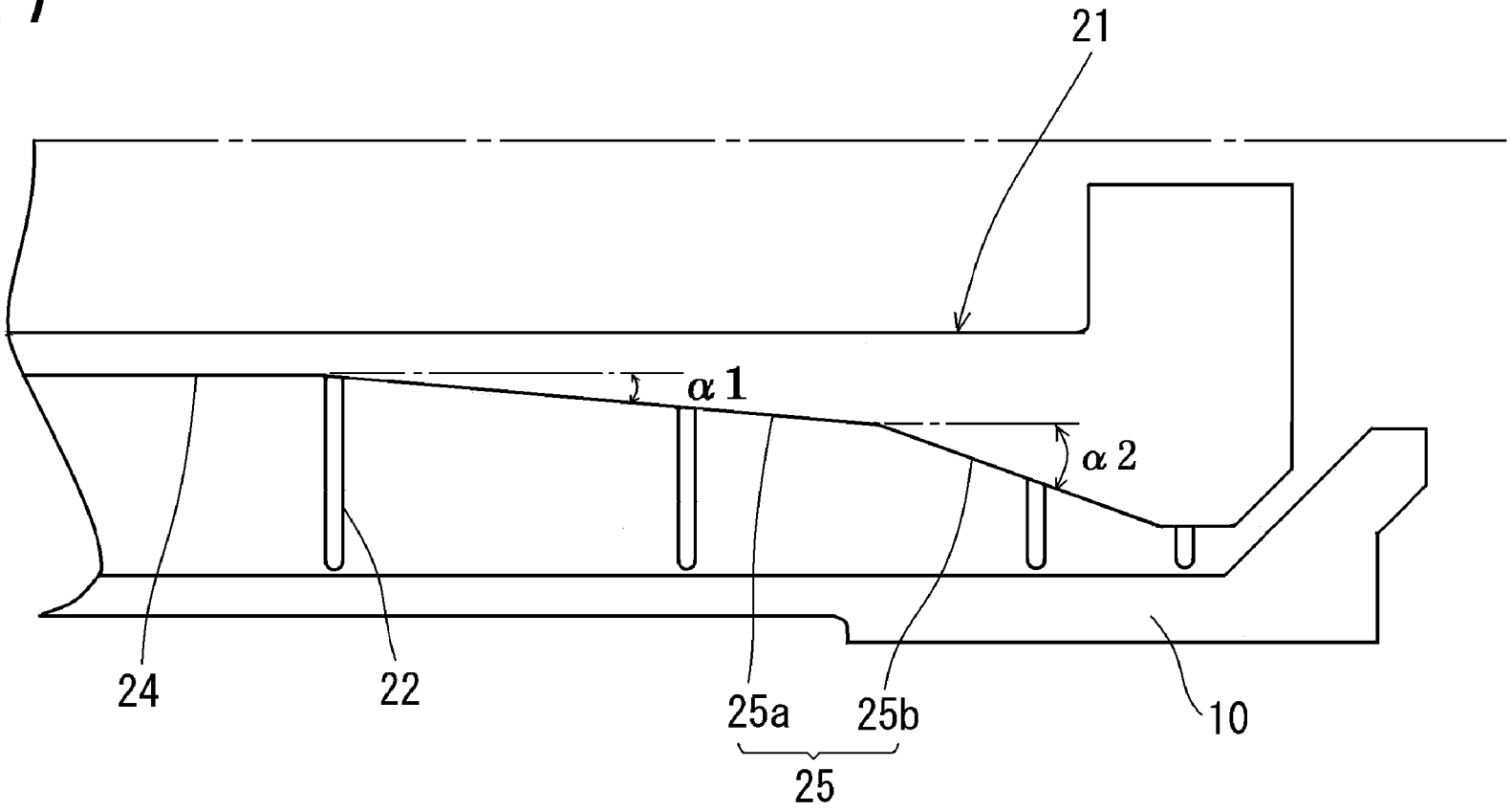
FIG. 7 is an enlarged schematic sectional view of a front cross section of a substantial part of a centrifugal dehydration device according to another embodiment of the present invention.

FIG. 7 shows another embodiment of the present invention which prevents an occurrence of the short path. In the following embodiment, parts similar to those of the embodiment described above are denoted by similar reference numerals and only substantial parts that differ from the embodiment above will be described.

The present embodiment is characterized in that the tapered section 25 of the rotary drum 21 is given a two-stage structure. Specifically, a first stage is given a gentle tapered section 25*a* (inclination angle $\alpha$1=5 to 15 degrees) and a second stage is given a tapered section 25*b* (inclination angle $\alpha$2=20 to 60 degrees) with a steeper slope than the first stage. By giving the tapered section 25 such a two-stage structure, the dewatered cake is compressed in the gentle tapered section 25*a* of the first stage. In addition, due to the steep-sloped tapered section 25*b* of the second stage, a radially-inward high-moisture content dewatered cake moves in the gentle tapered section 25 toward the separated liquid side without moving toward the cake discharge opening at the bottom portion of the bowl. As a result, it was found that a moisture content of an external dewatered cake having been discharged from the discharge path can be lowered by approximately 3 to 4% compared to conventional straight-drum types.

Figure 8:
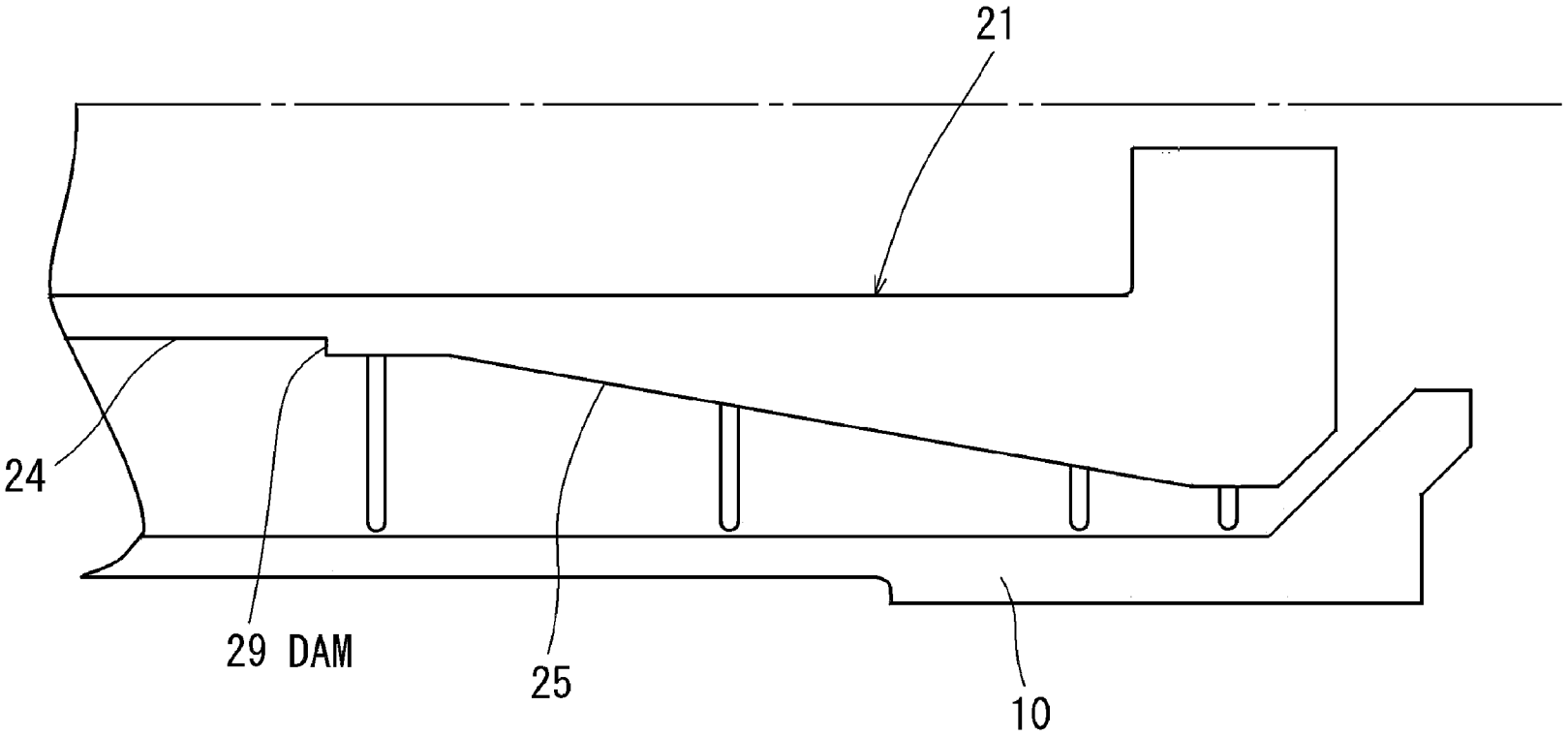
FIG. 8 is an enlarged schematic sectional view of a front cross section of a substantial part of a centrifugal dehydration device according to yet another embodiment of the present invention.

FIG. 8 shows yet another embodiment of the present invention which prevents an occurrence of the short path.

In the present embodiment, an occurrence of the short path is prevented by providing a dam 29 constituted by a ring or like with a height of around 10 mm at an entrance (a shape transformation point of the outer peripheral surface of the rotary drum) of the tapered section 25. By forming an uneven level and providing the dam 29 at the entrance of the tapered section 25 in this manner, the short path of the high-moisture content dewatered cake to the tapered section can be effectively prevented. Moreover, the dam is not limited to that described in the present embodiment and can alternatively be formed in the middle of the tapered section.

Figure 9:
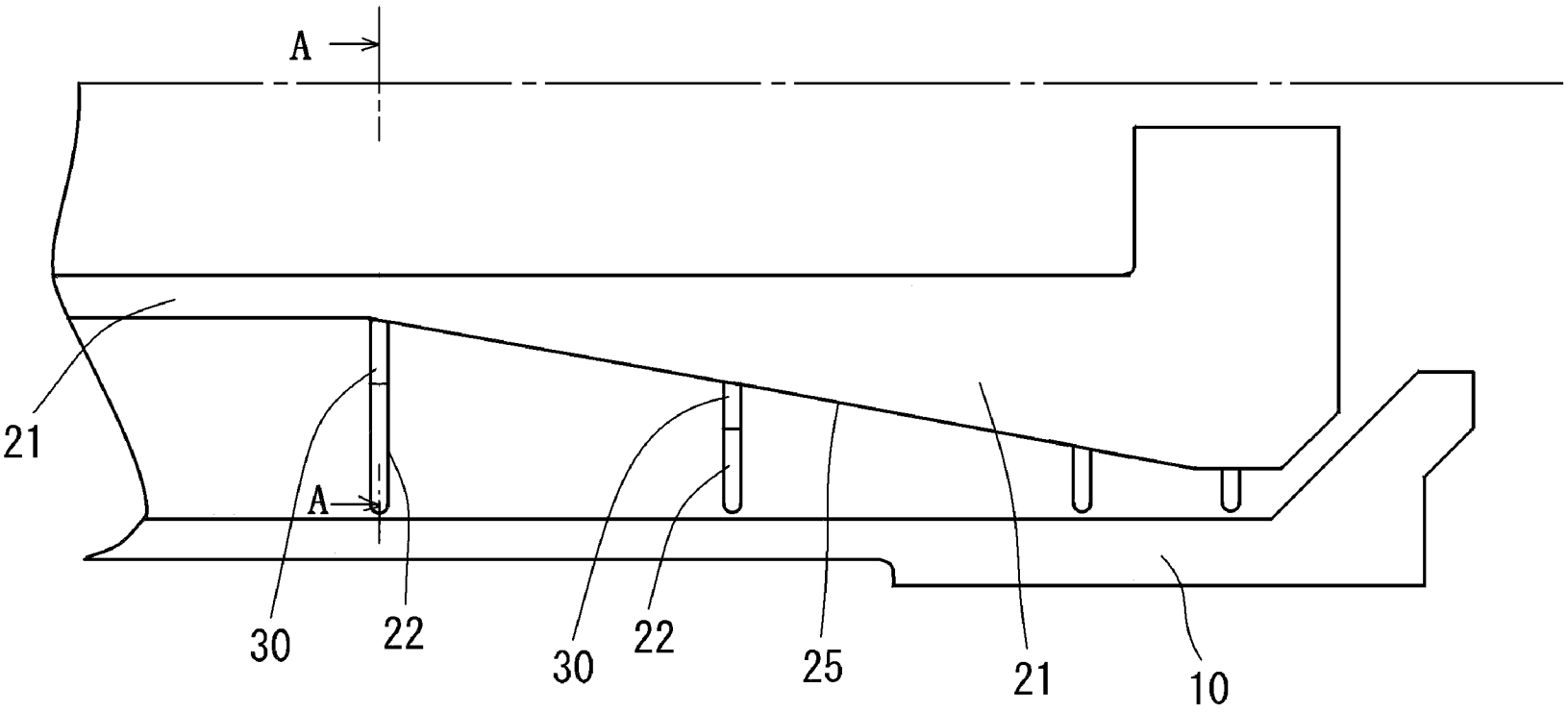
FIG. 9 is an enlarged schematic sectional view of a front cross section of a substantial part of a centrifugal dehydration device according to still another embodiment of the present invention.

FIG. 9 shows still another embodiment of the present invention which prevents an occurrence of the short path.

Figure 10:
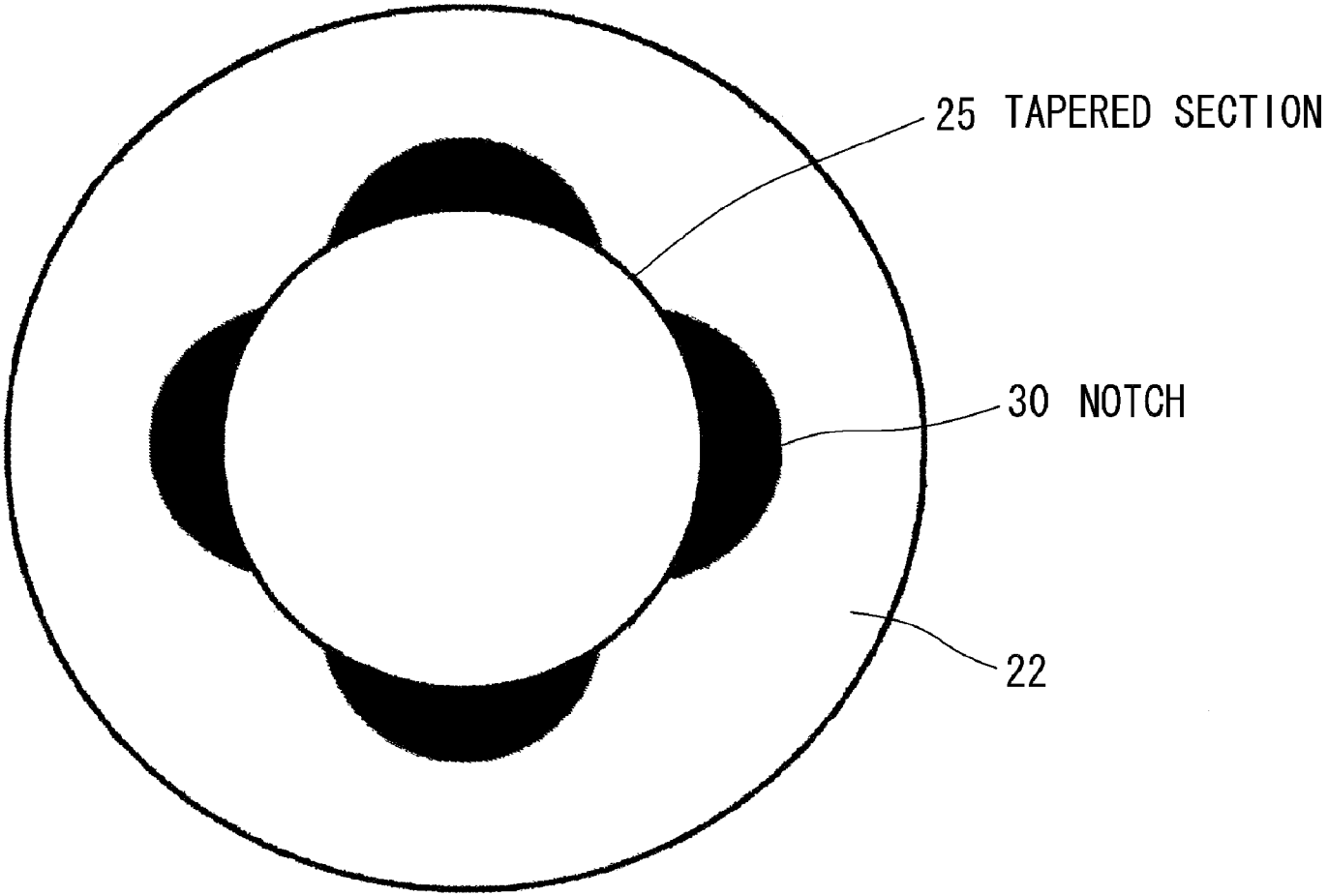
FIG. 10 is an arrow view taken along A-A of a spiral blade shown in FIG. 9.

With a centrifugal dehydration device according to the present embodiment, as schematically shown in FIG. 10, a notch 30 is partially provided at a connection between the spiral blade 22 of the tapered section 25 of the rotary drum 21 and a surface of the tapered section 25 in order to prevent the high-moisture content dewatered cake from being pushed up by the spiral blade 22 and moving on the tapered section 25. Accordingly, an inner-peripheral side dewatered cake in the tapered region is prevented from being transported and the short path of a high-moisture content dewatered cake towards the discharge side can be effectively prevented.

While the respective embodiments described above and shown in FIGS. 7 to 10 are capable of effectively preventing a short path of a high-moisture content dewatered cake, a short path can be more effectively prevented by combining these means.

Figure 11:
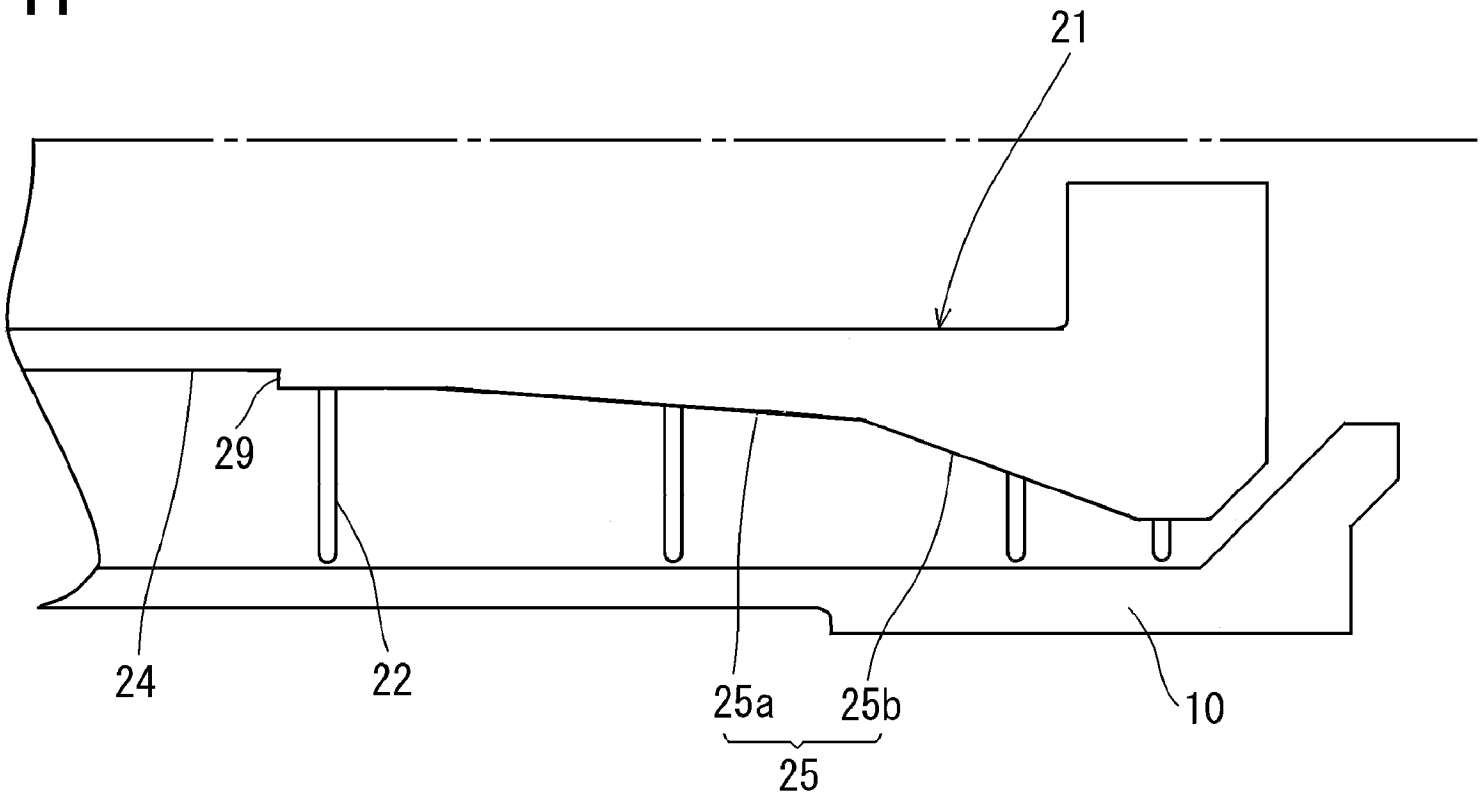
FIG. 11 is an enlarged schematic sectional view of a front cross section of a substantial part of a centrifugal dehydration device according to another embodiment of the present invention in which the embodiment shown in FIG. 8 has been added to the embodiment shown in FIG. 7.
Figure 12:
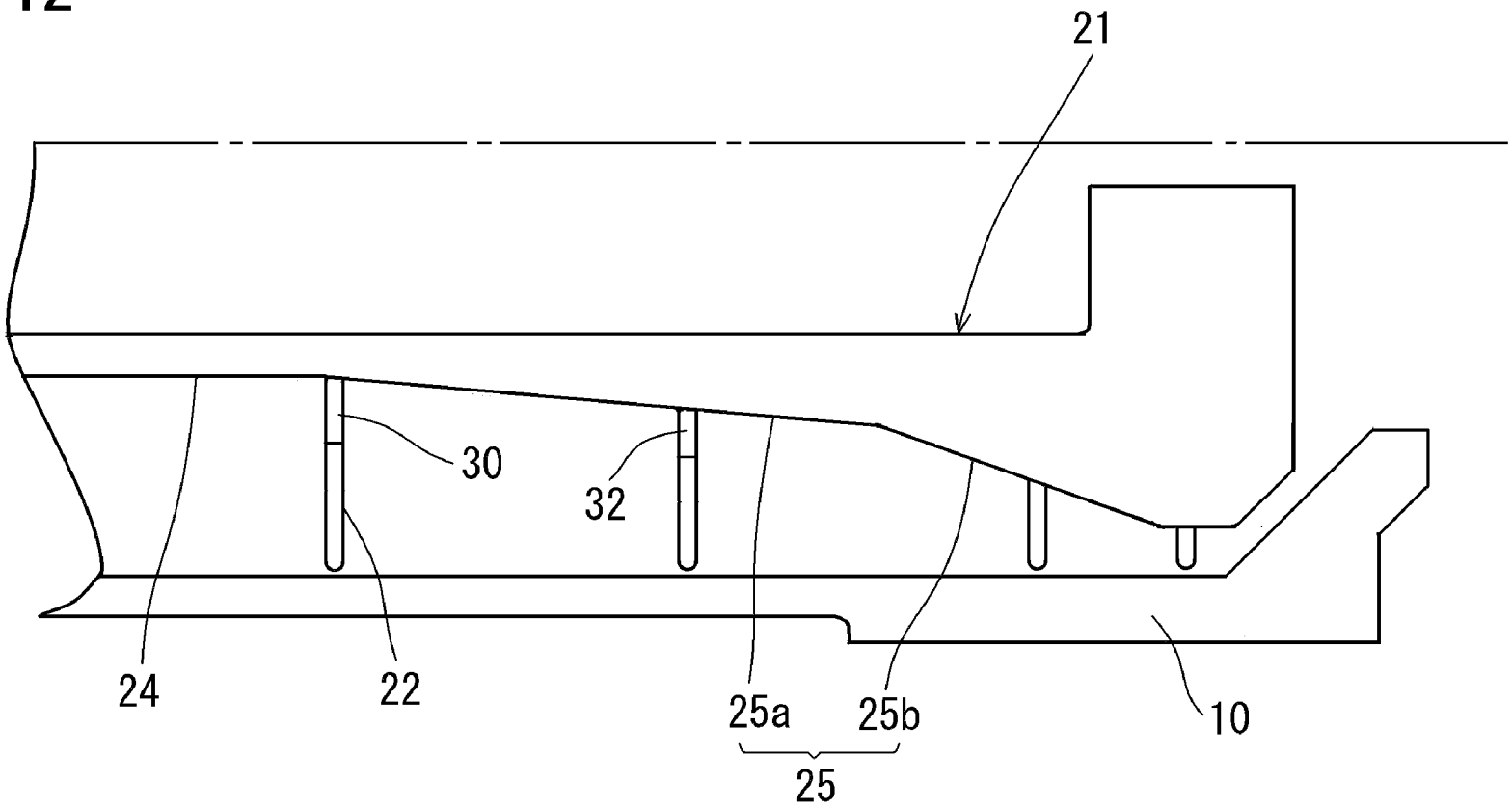
FIG. 12 is an enlarged schematic sectional view of a front cross section of a substantial part of a centrifugal dehydration device according to another embodiment of the present invention in which the embodiment shown in FIG. 9 has been added to the embodiment shown in FIG. 7.

FIG. 11 shows the short path preventing means according to the embodiment shown in FIG. 8 being added to the embodiment shown in FIG. 7. Parts similar to those of the embodiments described above are denoted by similar reference numerals and a detailed description thereof will be omitted. FIG. 12 shows the short path preventing means according to the embodiment shown in FIG. 9 being similarly added to the embodiment shown in FIG. 7. Parts similar to those of the embodiments described above are denoted by similar reference numerals and a detailed description thereof will be omitted.

EXAMPLES

Effects of varying methods of adding an inorganic flocculant and a polymeric flocculant on cake moisture content were examined using the centrifugal dehydration device according to the embodiment shown in FIG. 1. Moreover, all of the examples and the comparative examples described below were conducted within a recovery ratio range of 96 to 98%.

Example 1

Processing liquid: digested sludge

Inorganic flocculant: polyferric sulfate

Polymeric flocculant: polyamphoteric flocculant

Figure 13:
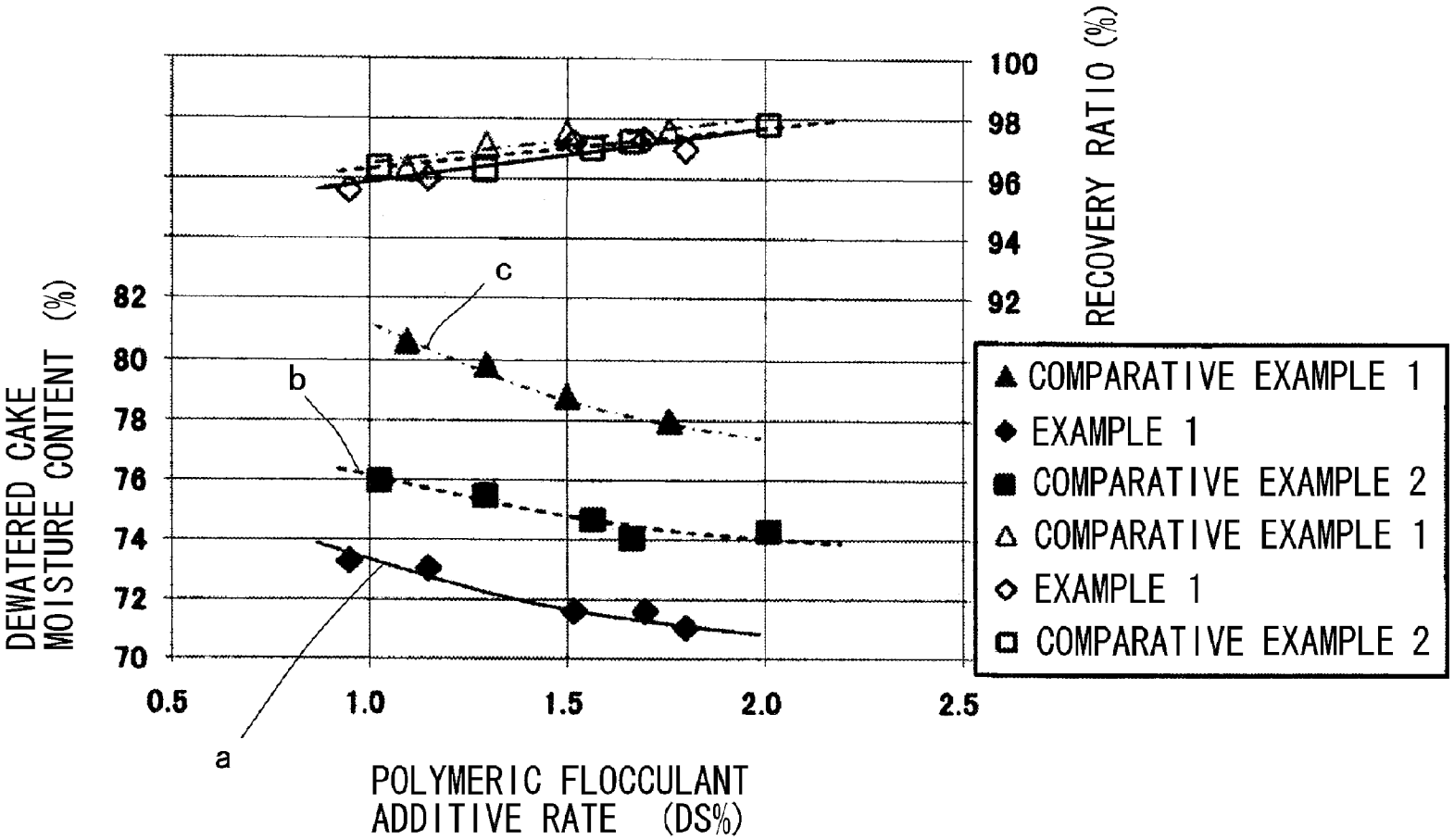
FIG. 13 is a graph showing a variation in dewatered cake moisture content relative to polymeric flocculant additive rate according to an example and comparative examples.

Addition method: As shown in Table 1, a variation in cake moisture content was examined when the polymeric flocculant was varied within an additive rate range of 0.92 to 1.80 DS % and fed to the processing liquid feed chamber to be agitated and mixed with the processing liquid, and polyferric sulfate was constantly added in a constant quantity (additive quantity: 19.0 L/h) from the orifices and the nozzle. Consequently, a result represented by Table 1 and by a line a in a graph shown in FIG. 13 was obtained. The result revealed that the present example achieved an extremely low moisture content of approximately 73.4% at a cake moisture content polymeric flocculant additive rate of 0.92 DS %, approximately 71.6% at an additive rate of 1.55 DS %, and 71.1% at an additive rate of 1.80 DS %, which confirmed that the present example has an extremely high dehydration effect.

Comparative Example 1

Variations in additive rate and cake moisture content were examined by adding only the polymeric flocculant according to example 1 to a processing liquid similar to that of example 1. A result thereof is represented by a line c in FIG. 13 together with example 1.

Comparative Example 2

As shown in Table 1, to a processing liquid similar to that in example 1, a polyamphoteric flocculant and polyferric sulfate similar to those used in the first example were pre-added (agitated and mixed in advance with the processing liquid prior to centrifugal dehydration through an agitation tank or piping) by a method similar to a conventional two-liquid method, with the inorganic flocculant added in a constant quantity in a similar manner to example 1 and the additive rate of the polymeric flocculant varied in a similar manner to example 1. A result thereof is shown in Table 1 and is represented by a line b in FIG. 13 together with example 1.

approximately 2 to 3% compared to comparative example 2 in which the inorganic flocculant is pre-added even when the additive quantities of both the inorganic flocculant and the polymeric flocculant were approximately the same as those in example 1. Furthermore, compared to comparative example 1 in which only the polymeric flocculant is added, the example produced a moisture content that is lower by approximately 6% or more.

From the example described above, it was confirmed that the device and the chemical agent addition method according to the present embodiment have a significantly greater dehydration effect than conventional art. In addition, the example and both comparative examples were free of dewatered cake discharge failures and were capable of favorably discharging a dewatered cake even when the dewatered cake had a high moisture content, and confirmed that the centrifugal dehydration device according to the present embodiment has a superior centrifugal dehydration function.

TABLE 1

| | SLUDGE TYPE: DIGESTED SLUDGE | | | | | CAKE |
|---|---|---|---|---|---|---|
| | | NO. OF | | FED LIQUID | | MOISTURE |
| | CENTRIFUGAL EFFECT (G) | BOWL REVOLUTIONS ($min^{-1}$) | DIFFERENTIAL SPEED ($min^{-1}$) | FEED QUANTITY ($m^3/h$) | CONCENTRATION (%) TS | CONTENT (%) ANALYSIS |
| EXAMPLE 1 | TWO-LIQUID (POST-ADDED) (AMPHOLYTIC POLYMER & POLYFERRIC SULFATE) | | | | | |
| | 2500 | 3600 | 1.2 | 5.0 | 1.69 | 73.4 |
| | 2500 | 3600 | 1.7 | 5.0 | 1.77 | 73.3 |
| | 2500 | 3600 | 1.7 | 5.0 | 1.81 | 71.6 |
| | 2500 | 3600 | 1.5 | 5.0 | 1.79 | 71.8 |
| | 2500 | 3600 | 1.3 | 5.0 | 1.78 | 71.1 |
| COMPARATIVE EXAMPLE 1 | ONE-LIQUID (CATIONIC POLYMER USED ALONE) | | | | | |
| | 2500 | 3600 | 1.2 | 5.0 | 1.78 | 80.5 |
| | 2500 | 3600 | 1.3 | 5.0 | 1.77 | 79.6 |
| | 2500 | 3600 | 1.3 | 5.0 | 1.80 | 78.5 |
| | 2500 | 3600 | 2.6 | 5.0 | 1.69 | 77.8 |
| COMPARATIVE EXAMPLE 2 | TWO-LIQUID (PRE-ADDED) (AMPHOLYTIC POLYMER & POLYFERRIC SULFATE) | | | | | |
| | 2500 | 3600 | 1.2 | 5.0 | 1.77 | 75.9 |
| | 2500 | 3600 | 1.7 | 5.0 | 1.69 | 75.3 |
| | 2500 | 3600 | 1.7 | 5.0 | 1.76 | 74.5 |
| | 2500 | 3600 | 1.5 | 5.0 | 1.78 | 74.0 |
| | 2500 | 3600 | 1.3 | 5.0 | 1.76 | 74.2 |

| | | POLYMERIC FLOCCULANT | | | INORGANIC FLOCCULANT | | |
|---|---|---|---|---|---|---|---|
| | RECOVERY RATIO (%) | CONCENTRATION (%) | ADDITIVE QUANTITY ($m^3/h$) | ADDITIVE RATE (DS %) | POSITION | ADDITIVE QUANTITY (L/h) | ADDITIVE RATE (DS %) |
| EXAMPLE 1 | TWO-LIQUID (POST-ADDED) (AMPHOLYTIC POLYMER & POLYFERRIC SULFATE) | | | | | | |
| | 95.6 | 0.2 | 0.39 | 0.92 | REAR | 19.0 | 32.6 |
| | 96.0 | 0.2 | 0.51 | 1.15 | REAR | 19.0 | 31.1 |
| | 97.4 | 0.2 | 0.70 | 1.55 | REAR | 19.0 | 30.4 |
| | 97.3 | 0.2 | 0.75 | 1.68 | REAR | 19.0 | 30.8 |
| | 97.1 | 0.2 | 0.80 | 1.80 | REAR | 19.0 | 31.0 |
| COMPARATIVE EXAMPLE 1 | ONE-LIQUID (CATIONIC POLYMER USED ALONE) | | | | | | |
| | 96.1 | 0.2 | 0.50 | 1.12 | | | |
| | 97.1 | 0.2 | 0.58 | 1.31 | | | |
| | 97.4 | 0.2 | 0.68 | 1.51 | | | |
| | 97.7 | 0.2 | 0.74 | 1.75 | | | |
| COMPARATIVE EXAMPLE 2 | TWO-LIQUID (PRE-ADDED) (AMPHOLYTIC POLYMER & POLYFERRIC SULFATE) | | | | | | |
| | 96.3 | 0.2 | 0.45 | 1.02 | FRONT | 19.0 | 31.1 |
| | 96.2 | 0.2 | 0.55 | 1.30 | FRONT | 19.0 | 32.6 |
| | 97.1 | 0.2 | 0.69 | 1.57 | FRONT | 19.0 | 31.3 |
| | 97.3 | 0.2 | 0.74 | 1.66 | FRONT | 19.0 | 31.0 |
| | 97.8 | 0.2 | 0.89 | 2.02 | FRONT | 19.0 | 31.3 |

As is apparent from the results of example 1 and comparative examples 1 and 2, a lower cake moisture content is achieved by example 1 when the additive rate of the polymeric flocculant is approximately the same. In addition, the example produced a moisture content that is lower by Next, a verification test represented by example 2 and comparative example 3 described below was performed in order to confirm the reduction in dewatered cake moisture content due to the rotary drum of the straight-drum centrifugal dehydrator according to the present invention having a tapered section that spreads outward and away as compared to a conventional straight-drum centrifugal dehydration device.

Example 2 and Comparative Example 3

As examples 2-1 to 2-3, testing machines were respectively fabricated by setting the centrifugal dehydration device according to the embodiment shown in FIG. 1 to $\alpha$=10 degrees and L1/L2=1.5/1 (example 2-1), L1/L2=1.2/1 (example 2-2), and L1/L2=1/1 (example 2-3), a dewatering process of mixed raw sludge as a processing liquid was carried out by the devices by performing only pre-addition of a polymeric flocculant, and a distribution state of an internal dewatering ratio was examined for each device.

In addition, as comparative example 3, a conventional straight-drum centrifugal dehydration device was used to perform a similar verification test of a dewatering process of similar mixed raw sludge, and a distribution state of an internal dewatering ratio was examined.

Measurement of a distribution state of an internal dewatering ratio was performed by forcing each centrifugal dehydration device to make an emergency stop during normal operation, dismantling the device after the device had come to a complete stop to collect an internally deposited cake that is deposited between screws in an axial cross section of the screw conveyor, and measuring cake moisture contents at three points including an outer peripheral side, center, and an inner peripheral side for each screw pitch. A result thereof is shown in FIG. 14.

Figure 14:
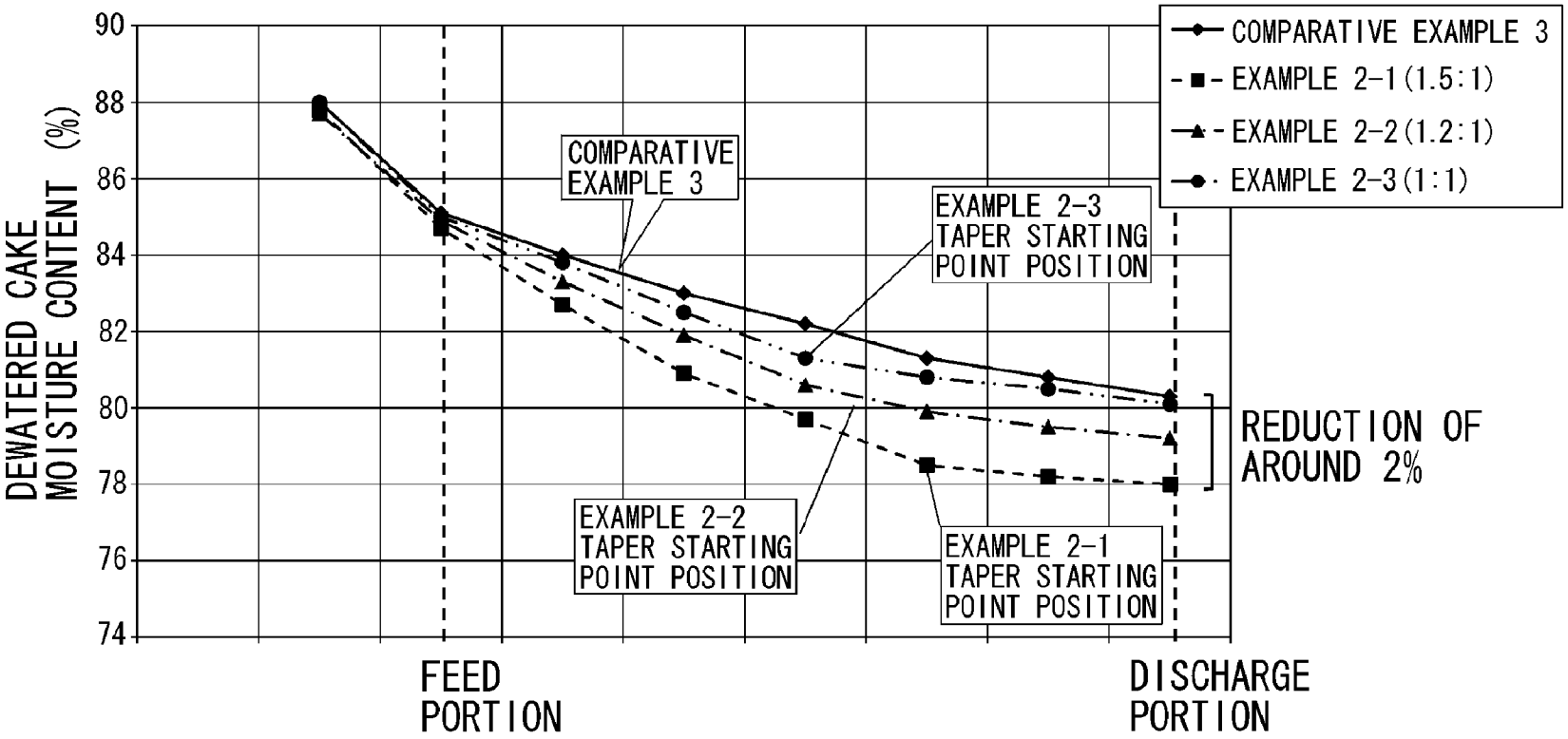
FIG. 14 is a graph showing a moisture content distribution of an internally-dewatered cake according to example 2 and comparative example 3.

The graph shown in FIG. 14 represents internal dewatering ratio distribution states of examples 2-1 to 2-3 and comparative example 3 measured as described above, and shows average values of the three points for each pitch. As a result, in the case of the comparative example that is a conventional straight-drum centrifugal dehydration device, the internal moisture content dropped almost linearly toward a discharge-side end portion as illustrated and the moisture content at a discharge-side side portion dropped to approximately 80.3%. In comparison, the internal moisture contents according to the examples all decreased at a higher reduction slope toward the taper starting point than the comparative example, and while the moisture content reduction slope became less steep at the tapered section, the moisture content continued to decrease up to the discharge portion. Among the examples, example 2-1 where L1/L2=1.5/1 exhibited the greatest reduction in moisture content which dropped to 78.0%, and a decline in moisture content that is greater by approximately 2% or more compared to conventional straight-drum centrifugal dehydrators was observed. This is conceivably because forming the downstream side of the outer peripheral surface of the rotary drum in a tapered shape increases discharge resistance and volume reducing force and, as a result, the decreasing rate of the moisture content toward the taper starting point in the straight section increased at a steeper slope than in the comparative example. Therefore, it was confirmed that the dewatered cake moisture content can be further lowered by forming the downstream portion of the rotary drum in a tapered shape. In addition, as for the effect of L1/L2 to moisture content in example 2, it was confirmed that pushing pressure can be more sufficiently secured and moisture content can be lowered more effectively in example 2-1 than in examples 2-2 and 2-3. Moreover, in the graph shown in FIG. 14, "feed portion" refers to a position corresponding to the feed opening 27 in the straight-drum centrifugal dehydration device according to the embodiment shown in FIG. 1, and "discharge portion" refers to a position corresponding to the entrance 53 of the dewatered cake discharge path in the straight-drum centrifugal dehydration device according to the embodiment shown in FIG. 1.

Example 3 and Comparative Example 4

Figure 15:
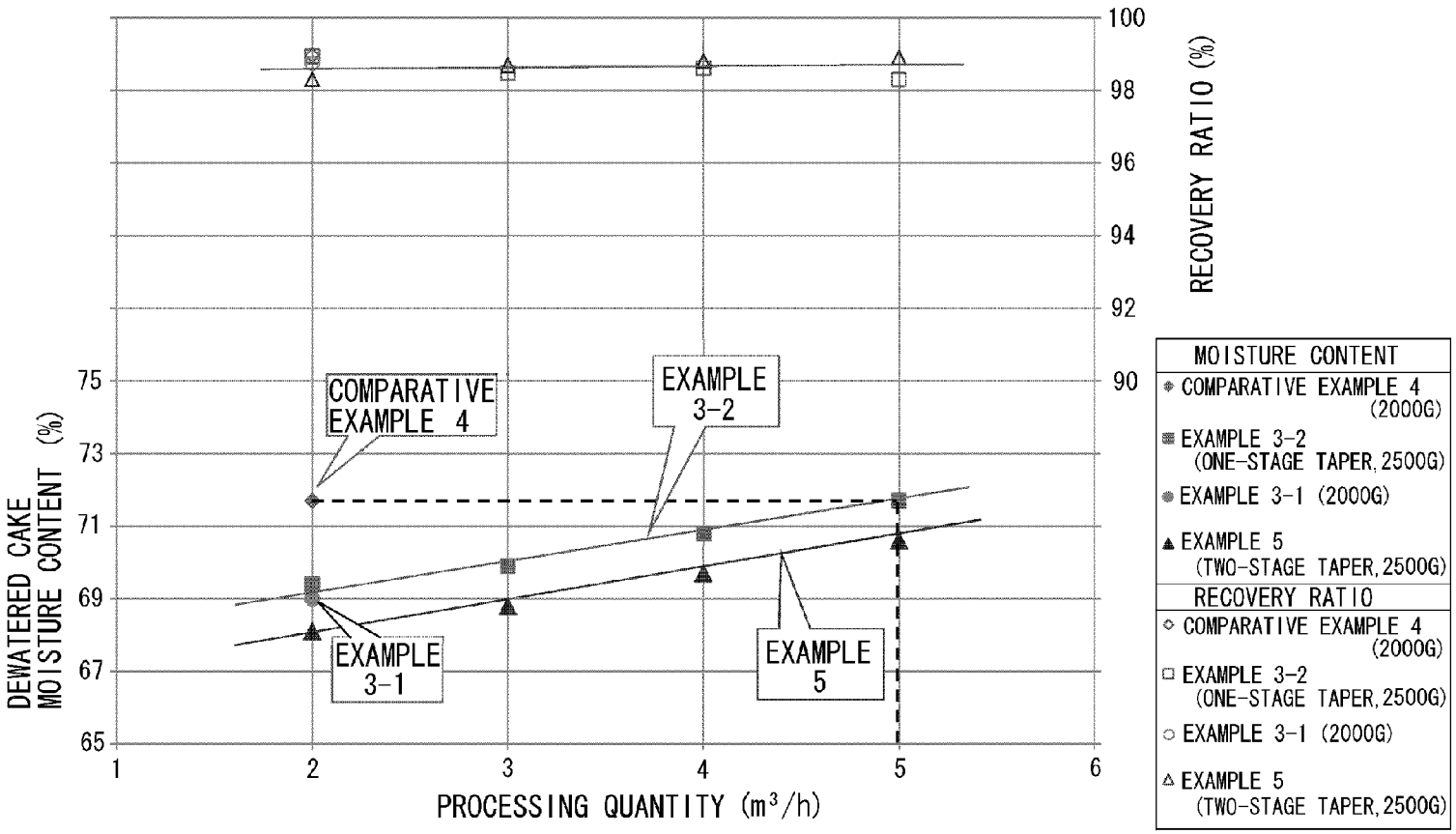
FIG. 15 is a graph showing a relationship between dewatered cake moisture content and processing quantity according to example 3 and comparative example 4.
Figure 16:
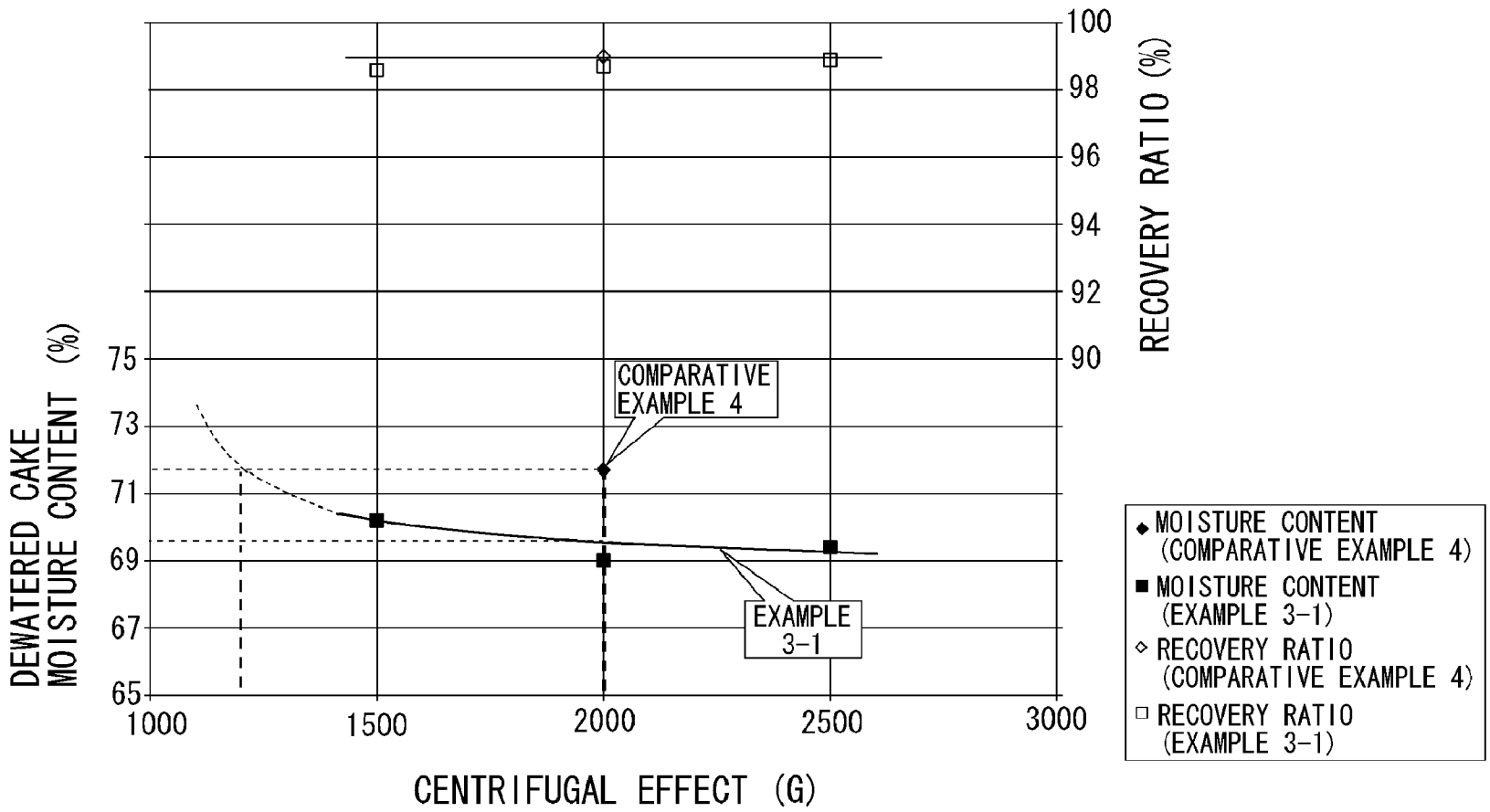
FIG. 16 is a graph showing a relationship between dewatered cake moisture content and centrifugal effect according to example 3 and comparative example 4.

Using the centrifugal dehydration device adopted in example 2-1, an effect of a centrifugal effect when a dewatering process is performed on mixed raw sludge as a processing liquid in a similar manner to example 2 was examined. A result thereof is shown in FIG. 15. FIG. 15 shows dewatered cake moisture contents when processing of 2 $m^3$/h is performed at 2000 G and a recovery ratio of 98% or higher based on centrifugal effects according to example 3-1 and comparative example 4, and also shows a relationship between dewatered cake moisture content and processing quantity when processing of 2 to 5 $m^3$/h is performed based on a centrifugal effect of 2500 G according to example 3-2. FIG. 16 shows a relationship between centrifugal effect and dewatered cake moisture content. Moreover, the respective graphs in FIGS. 15 and 16 also display recovery ratios at the time of processing. Furthermore, FIG. 15 also displays a result of example 5 (to be displayed later).

The dewatered cake moisture content when processing mixed raw sludge at a processing quantity of 2 $m^3$/h using the device according to example 3-1 was 69.0% at a centrifugal effect of 2000 G. In comparison, the dewatered cake moisture content when similarly processing mixed raw sludge at a processing quantity of 2 $m^3$/h using the device according to comparative example 1 was 71.8% at a centrifugal effect of 2000 G (example 3-1, comparative example 4).

In other words, example 3-1 was able to lower the moisture content by approximately 2% more than comparative example 4, thereby confirming the effectiveness of the present invention. In addition, while a relationship between processing quantity and dewatered cake moisture content when performing processing at a centrifugal effect of 2500 G is shown for example 3-2, dewatered cake moisture content correlatively increased as the processing quantity increased. This trend is likely to also apply to a case where the centrifugal effect is 2000 G. Therefore, if a dewatering process is to be performed using the device according to example 2-1 at a moisture content of 71.8% that is the same as the device according to comparative example 2, processing can be performed at 5 $m^3$/h with the device according to the example as shown in the graph in FIG. 15, and example 3-1 may be expected to be able to process a quantity that is 2 to 2.5 times that of comparative example 4. Furthermore, as shown in the graph in FIG. 16, a decline in centrifugal effect of around ½ is observed at the same moisture content, and device load can be reduced accordingly. As a result, compared to the comparative example, downsizing and an increase in capacity can be achieved by the example. Therefore, compared to the comparative example, a significant reduction in cost and power consumption can be achieved.

Example 4 and Comparative Example 5

Prototypes were respectively created by respectively setting the taper angle of a device similar to that of example 2-1 (L1/L2=1.5/1) to 10 degrees (example 4-1), 30 degrees (example 4-2), and 40 degrees (example 4-3), and a dewatering process of anaerobic digested sludge as a processing liquid was carried out. The anaerobic digested sludge that is a processing liquid used in the verification test had a dewatered cake concentration (TS) of 1.82% and an organic matter concentration (VTS) of 73.8%. The verification test was performed based on a centrifugal effect of 2500 G and a recovery ratio of 99% or higher in four stages by varying the processing quantity from 2.0 to 5.0 $m^3/h$ in increments of 1.0 $m^3/h$. Respective dewatered cake moisture contents were as shown in FIG. 17.

Figure 17:
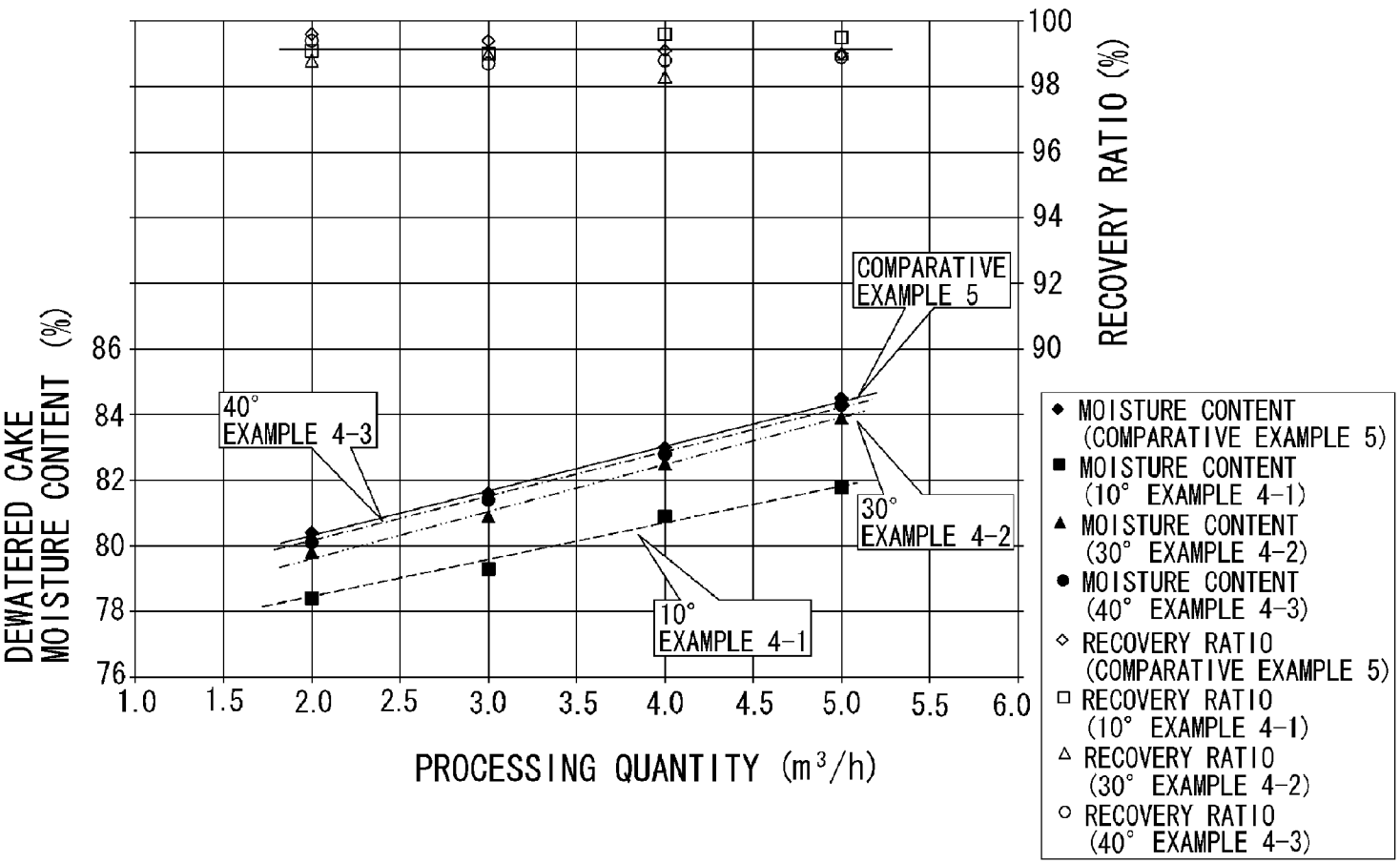
FIG. 17 is a graph showing a relationship between dewatered cake moisture content and processing quantity according to example 4 and comparative example 5.

As is apparent from FIG. 17, while dewatered cake moisture content increases when processing quantity increases under the same centrifugal effect, the examples exhibited lower cake moisture contents than the comparative examples regardless of the processing quantity. In particular, example 4-1 with a taper angle of 10 degrees exhibited a reduction of around 2.0 to 2.7% as compared to comparative examples and a significant effect was observed. Moreover, among the examples, a smaller taper angle of the rotary drum resulted in a greater reduction effect of the dewatered cake moisture content. As described above, with the straight-drum centrifugal dehydration device according to the present invention, effects similar to those in the case of mixed raw sludge were observed for anaerobic digested sludge. Therefore, the straight-drum centrifugal dehydration device according to the present invention was found to be effective for dewatering regardless of the processing liquid type.

Example 5

In order to confirm an effect of constructing the tapered section of the rotary drum as a two-stage taper as shown in FIG. 7, a straight-drum centrifugal dehydration device with a first-stage taper angle of 10 degrees and a second-stage taper angle of 30 degrees was fabricated and a relationship between processing quantity and dewatered cake moisture content in the device based on a centrifugal effect of 2500 G was examined. The results thereof are shown in Table 2 and FIG. 15. Moreover, the processing liquid (sludge type) was mixed raw sludge in a similar manner to example 3-1 and comparative example 4.

TABLE 2

| | DEWATERED CAKE MOISTURE CONTENT (%) | | | |
|---|---|---|---|---|
| PROCESSING QUANTITY ($m^3/h$) | 2 | 3 | 4 | 5 |
| EXAMPLE 5 | 68.1 | 68.8 | 69.7 | 70.6 |
| EXAMPLE 3-1 | 69.4 | 69.9 | 70.8 | 71.7 |

As is apparent from Table 2, by adopting a two-stage taper, example 5 was able to lower moisture content by approximately 1% as compared to example 3-1 having a one-stage taper.

INDUSTRIAL APPLICABILITY

The straight-drum centrifugal dehydration device according to the present invention can be utilized in sewage treatment and industrial wastewater treatment, a dewatering process of several products in chemical and food industries, or the like.

The invention claimed is:

1. A centrifugal dehydration method implemented by a straight-drum centrifugal dehydration device in which solid/liquid separation of a processing liquid is performed and solids and a separated liquid are recovered, with this device being formed to have a straight-drum bowl which rotates in one direction and a screw conveyor constructed by having a spiral blade wound around an outer periphery of a rotary drum which is housed in the bowl and which coaxially rotates with the bowl in the same direction while having a difference in rotational speed from the bowl, with the straight-drum centrifugal dehydration device being formed of a straight section in which an inner peripheral wall of the bowl forms a cylindrical shape extending along a rotating shaft of the bowl, and in which an upstream side of an outer peripheral surface of the rotary drum of the screw conveyor is formed a straight section constituted by a straight circumferential surface, and a downstream side of the straight section of said rotary drum connects to a tapered section which spreads outward and away from the straight section of said rotary drum, wherein a ratio L1/L2 of an axial length L1 of the straight section from a processing liquid feed opening of the rotary drum (21) to a starting point of the tapered section and an axial length L2 of the tapered section of the rotary drum ranges from 1.2 to 5.0, and an inclination angle of a taper starting portion of the tapered section ranges from 5 to 30 degrees, and wherein an inverse tapered surface that is inclined inward from a downstream end of the tapered section is formed, the inverse tapered surface forms a choke passage whose sectional area gradually decreases toward the downstream side and functions as a dewatered cake discharge path together with a bowl-side inverse tapered surface, the method being implemented in which the processing liquid is fed into an annular space between the bowl and the screw conveyor via a processing liquid feed chamber formed inside the rotary drum, while solid/liquid is separated by centrifugal force created by rotation of the bowl and the screw conveyor, the separated liquid is discharged from a separated liquid discharge opening, a dewatered cake is pushed into a dewatered cake discharge path by centrifugal head pressure and a transport force of the screw conveyor, the dewatered cake is gradually moved to a high-centrifugal force field by the tapered section toward the dewatered cake discharge path and is dewatered by gradually reducing a passage area of the dewatered cake toward the side of the dewatered cake discharge path, and the dewatered cake passing the tapered section is squeezed in the choke passage and further dewatered.

2. The centrifugal dehydration method adopted by the straight-drum centrifugal dehydration device according to claim 1, comprising:

a processing liquid feeding step of feeding the processing liquid and a polymeric flocculant into the processing liquid feed chamber; and an inorganic flocculant adding step of feeding the processing liquid, to which the polymeric flocculant has been added from the processing liquid feed chamber, to an annular space in an inner periphery of the bowl via a feed opening formed on the rotary drum and adding an inorganic flocculant from inside the rotary drum of the screw conveyor to the dewatered cake which is transported by the screw conveyor while being dewatered by centrifugal force.

3. The centrifugal dehydration method according to claim 2, wherein in the inorganic flocculant adding step, the inorganic flocculant is added to the dewatered cake between the straight section of the screw conveyor on a downstream side of the feed opening and an upstream end of the tapered section.

4. The centrifugal dehydration method according to claim 3, wherein the addition of the inorganic flocculant is performed by a combination of adding the inorganic flocculant to a surface of the dewatered cake and adding the inorganic flocculant to an inside of the dewatered cake.

5. A straight-drum centrifugal dehydration device comprising:

a straight-drum bowl which rotates in one direction; and a screw conveyor constructed by having a spiral blade wound around an outer periphery of a rotary drum which is housed in the bowl and which coaxially rotates with the bowl in the same direction while having a difference in rotational speed from the bowl, the straight-drum centrifugal dehydration device further comprising:

a straight section in which an inner peripheral wall of the bowl forms a cylindrical shape extending along a rotating shaft of the bowl and in which an upstream side of an outer peripheral surface of the rotary drum of the screw conveyor includes a straight section having a straight circumferential surface; and a tapered section whose downstream side spreads outward and away from the straight section of said rotary drum, wherein an inclination angle of a taper starting portion of the tapered section ranges from 5 to 30 degrees, wherein a ratio L1/L2 of an axial length L1 of the straight section of the rotary drum from a processing liquid feed opening of the rotary drum to a starting point of the tapered section and an axial length L2 of the tapered section of the rotary drum ranges from 1.2 to 5.0, and wherein an inverse tapered surface that is inclined inward from a downstream end of the tapered section is formed, the inverse tapered surface forms a choke passage whose sectional area gradually decreases toward the downstream side and functions as a dewatered cake discharge path together with a bowl-side inverse tapered surface.

6. The straight-drum centrifugal dehydration device according to claim 5, comprising an inorganic flocculant feed path which feeds an inorganic flocculant to an inner peripheral surface of the straight section of the rotary drum, wherein an inorganic flocculant addition nozzle is provided in the straight section, the inorganic flocculant addition nozzle communicating with the inorganic flocculant feed path, and penetrating the rotary drum, and moreover protruding into an annular space of the bowl and an orifice for adding the inorganic flocculant.

7. The straight-drum centrifugal dehydration device according to claim 5, wherein the tapered section has a two-stage structure with different inclination angles including a first-stage inclination angle that is a shallow acute inclination angle and a subsequent second-stage inclination angle that is steeper than the first-stage inclination angle.

8. The centrifugal dehydration device according to claim 5, wherein a dam constituted by an uneven surface is formed at a boundary portion between the straight section and the tapered section and/or in the middle of the tapered section.

9. The centrifugal dehydration device according to claim 5, wherein a notch is provided at a part of a base portion of the spiral blade attached to the rotary drum arranged in the tapered section.

10. The centrifugal dehydration method according to claim 1, wherein the ratio L1/L2 is between 1.2 to 1.5.

11. The centrifugal dehydration method according to claim 10, wherein the inclination angle is less than 15 degrees.

12. The centrifugal dehydration method according to claim 1, wherein the inclination angle is less than 15 degrees.

13. The centrifugal dehydration device according to claim 5, wherein the ratio L1/L2 is between 1.2 to 1.5.

14. The centrifugal dehydration method according to claim 13, wherein the inclination angle is less than 15 degrees.

15. The centrifugal dehydration method according to claim 1, wherein the inclination angle is less than 15 degrees.

* * * * *